US011397403B2

(12) United States Patent
Uehashi et al.

(10) Patent No.: US 11,397,403 B2
(45) Date of Patent: Jul. 26, 2022

(54) IMAGE FORMATION APPARATUS INCLUDING FIXATION DEVICE WITH HANDLE

(71) Applicant: Oki Electric Industry Co., Ltd., Tokyo (JP)

(72) Inventors: Tetsuya Uehashi, Tokyo (JP); Teruo Soeda, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 17/403,450

(22) Filed: Aug. 16, 2021

(65) Prior Publication Data

US 2022/0128945 A1 Apr. 28, 2022

(30) Foreign Application Priority Data

Oct. 26, 2020 (JP) ..... JP2020-179104

(51) Int. Cl.
*G03G 21/16* (2006.01)
*G03G 15/20* (2006.01)

(52) U.S. Cl.
CPC ..... *G03G 21/1685* (2013.01); *G03G 15/2017* (2013.01); *G03G 21/1619* (2013.01); *G03G 21/1647* (2013.01); *G03G 2221/1639* (2013.01)

(58) Field of Classification Search
CPC ..... G03G 15/2017; G03G 21/1619; G03G 21/1647; G03G 21/1685; G03G 2221/1639; G03G 2221/1678
See application file for complete search history.

(56) References Cited

U.S. PATENT DOCUMENTS

2006/0008294 A1* 1/2006 Ito ..... G03G 21/1685 399/122
2020/0073321 A1* 3/2020 Uehashi ..... G03G 21/1619
2021/0109475 A1* 4/2021 Sagawa ..... G03G 21/1685

FOREIGN PATENT DOCUMENTS

JP 2020-38342 A 3/2020

* cited by examiner

*Primary Examiner* — Sophia S Chen

(74) *Attorney, Agent, or Firm* — Metrolex IP Law Group, PLLC

(57) ABSTRACT

An image formation apparatus according to an embodiment may include: an apparatus housing including a stacker and an opening provided at the stacker; a fixation device removably attached to the apparatus housing through the opening and including a handle rotatable between an upright position and a laid-flat position; and a laid-flat position-keeping detent mechanism. In a state where the fixation device is attached to the apparatus housing, a portion of the fixation device that is exposed from the opening provided at the stacker forms a portion of the stacker and a connector of the fixation device is mated to a connector of the apparatus housing. By at least a predetermined force being applied to the handle to transition the handle from the upright position to the laid-flat position, the laid-flat position-keeping detent mechanism allows the handle to transition to the laid-flat position and keeps the handle in the laid-flat position.

9 Claims, 13 Drawing Sheets

IMAGE FORMATION APPARATUS INCLUDING FIXATION DEVICE WITH HANDLE

CROSS REFERENCE TO RELATED APPLICATIONS

This application claims priority based on 35 USC 119 from prior Japanese Patent Application No. 2020-179104 filed on Oct. 26, 2020, entitled "IMAGE FORMATION APPARATUS", the entire contents of which are incorporated herein by reference.

BACKGROUND

The disclosure may relate to an image formation apparatus.

An electrophotographic image formation apparatus, such as a photocopier, a printer, and a fax machine, is configured to form a developer image by electrophotography, and transfer the developer image to a medium, and then fixes the developer image transferred to the medium to the medium by a fixation device.

In a related art, such an image formation apparatus is provided with: an apparatus housing having, at an outer periphery thereof, a stacker to which a medium having a fixed image is discharged; and a fixation device that can be removably attached to the apparatus housing through an opening provided at the stacker, wherein when the fixation device is attached to the apparatus housing, a portion of the fixation device is exposed from the opening of the stacker so as to form a portion of the stacker (see, for example, Patent Document 1).

Patent Document 1: Japanese Patent Application Publication No. 2020-38342

SUMMARY

In the image formation apparatus described above, the fixation device can be directly attached to and removed from the apparatus housing without opening the cover of the apparatus housing, which facilitates the attachment and removal of the fixation device. However, there may be a problem that if, when the fixation device is inserted through the opening of the apparatus housing, the force of the insertion is insufficient, a connector of the fixation device fails to be mated to a connector of the apparatus housing, so that the attachment of the fixation device is incomplete.

An object of an embodiment of the disclosure may be to provide an image formation apparatus that allows reliable attachment of a fixation device.

An aspect of the disclosure may be an image formation apparatus that may include: an apparatus housing that includes, at an outer peripheral portion thereof, a stacker, an opening being provided at the stacker; an image formation unit that is provided in the apparatus housing and configured to form an image on a medium; and a fixation device that is removably attached to the apparatus housing through the opening, and is configured to fix the image formed on the medium by the image formation unit to the medium. In a state where the fixation device is attached to the apparatus housing, a portion of the fixation device that is exposed from the opening provided at the stacker forms a portion of the stacker, and a connector of the fixation device is mated to a connector of the apparatus housing. The fixation device includes, at the exposed portion thereof exposed from the opening, a handle that is allowed to transition between an upright position in which the handle stands with respect to the exposed portion and a laid-flat position in which the handle is laid flat with respect to the exposed portion. The image formation apparatus may further include a laid-flat position-keeping detent mechanism that, when at least a predetermined force is applied to the handle in order to transition the handle from the upright position to the laid-flat position, allows the handle to transition to the laid-flat position and keeps the handle in the laid-flat position.

According to the aspect described above, for example, after the handle of the fixation device is grasped in the upright position and the fixation device is inserted through the opening, at least a predetermined force set for the laid-flat position-keeping detent mechanism is applied to the handle in order to cause the handle to transition from the upright position to the laid-flat position. By this force, the connector of the fixation device can be reliably mated to the connector of the apparatus housing.

Thus, according to the aspect described above, an image formation apparatus can be implemented in which a fixation device can be reliably attached thereto.

DETAILED DESCRIPTION

Figure 1:
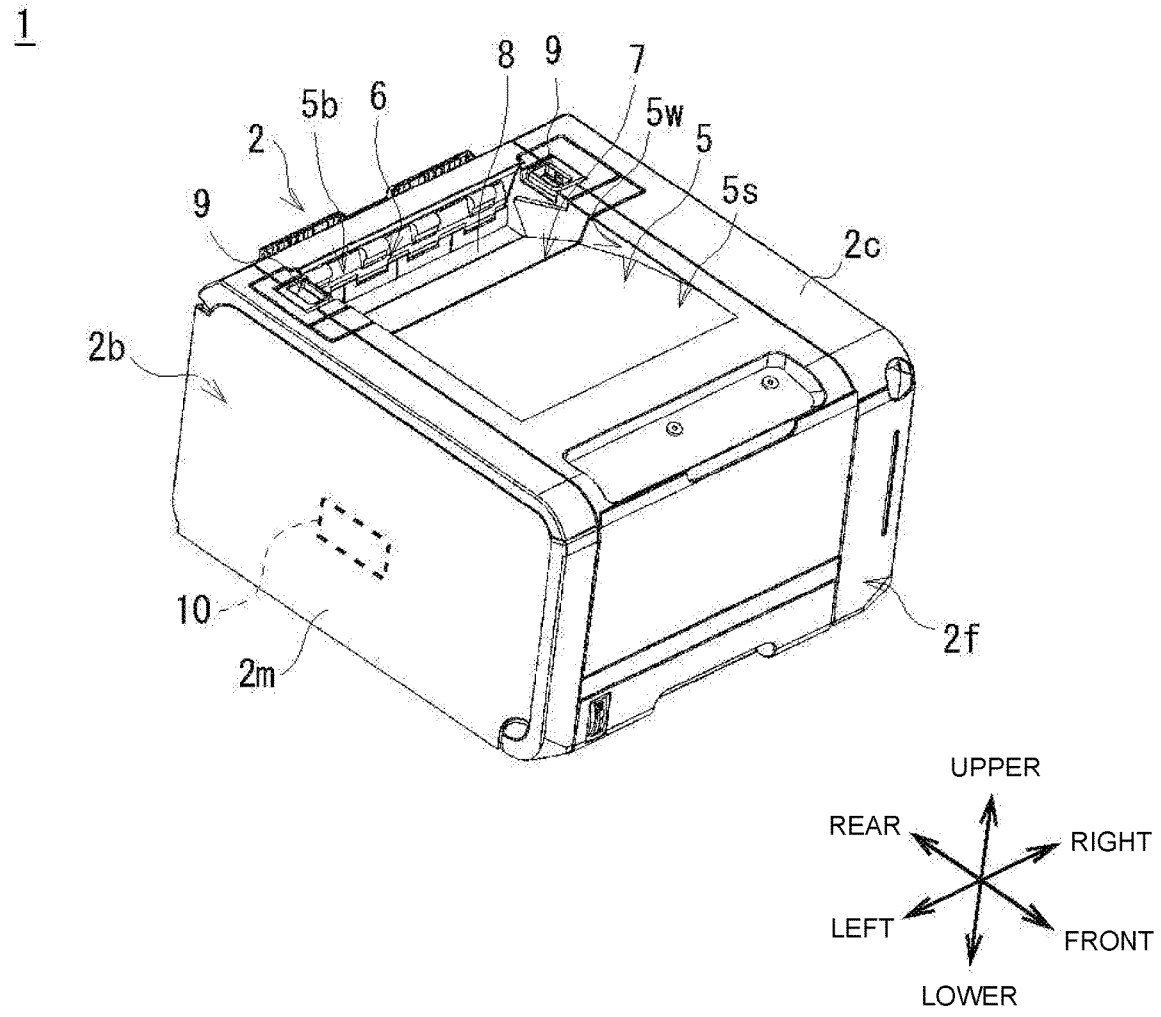
FIG. 1 is a perspective view illustrating an appearance or external configuration of an image formation apparatus.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

1. Configuration of Image Formation Apparatus

Figure 2:
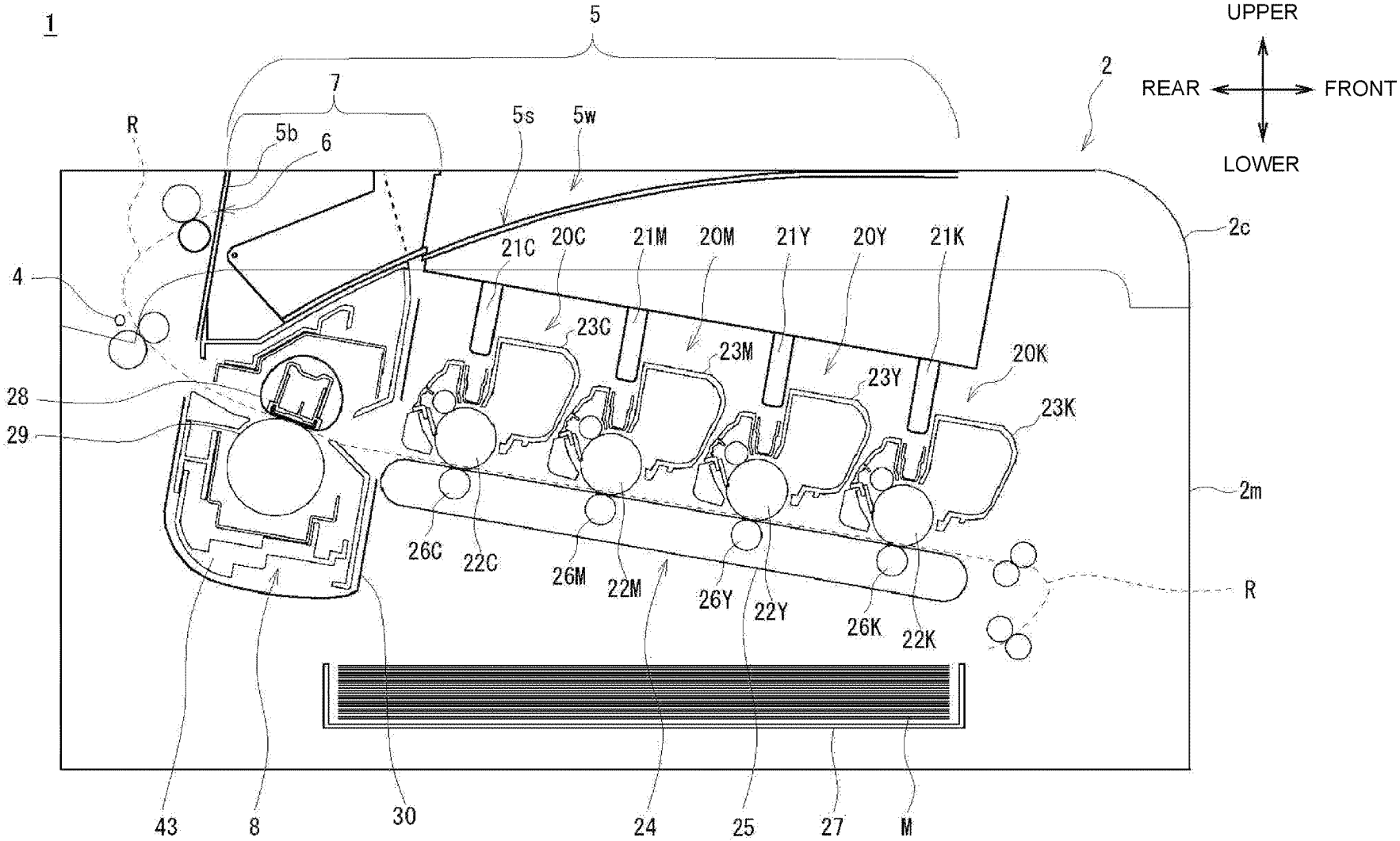
FIG. 2 is a side cross-sectional view illustrating an internal configuration of the image formation apparatus.

FIG. 1 and FIG. 2 illustrate a configuration of an image formation apparatus 1 according to an embodiment. The image formation apparatus 1 is a color printer that forms (i.e., prints) an image on paper by electrophotography. FIG. 1 is a perspective view illustrating an appearance or external configuration of the image formation apparatus 1. FIG. 2 is a side cross-sectional view illustrating an internal configuration of the image formation apparatus 1.

Firstly, an appearance or external configuration of the image formation apparatus 1 is described. As illustrated in FIG. 1, the image formation apparatus 1 has, as a cover, an apparatus housing 2 generally in the shape of a rectangular parallelepiped. A backward direction is herein defined as a direction from a front surface 2*f* to a rear surface 2*b* of the apparatus housing 2. A forward direction is herein defined as a direction from the rear surface 2*b* to the front surface 2*f*. An upward direction is herein defined as a direction from the bottom to top of the apparatus housing 2. A downward direction is herein defined as a direction from the top to bottom of the apparatus housing 2. A leftward direction is herein defined as a direction from the right to left of the apparatus housing 2. A rightward direction is herein defined as a direction from the left to right of the apparatus housing 2.

Figure 3:
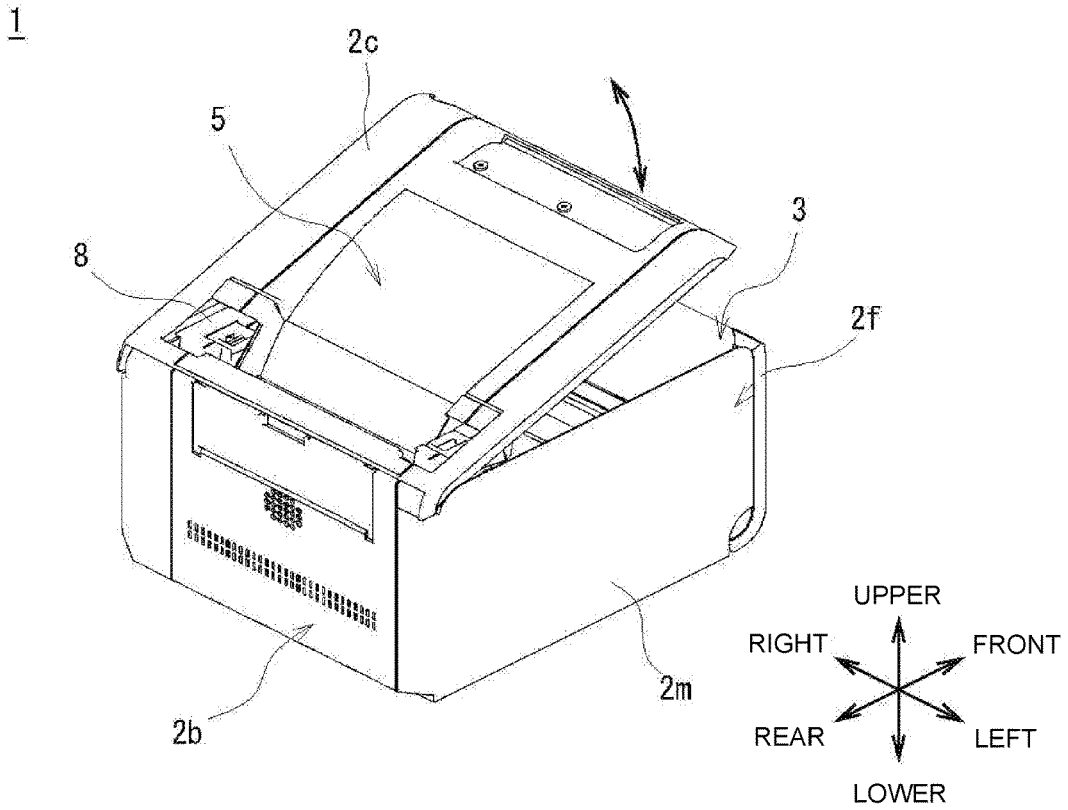
FIG. 3 is a perspective view illustrating an appearance or external configuration of the image formation apparatus with an apparatus cover open.

The apparatus housing 2 includes a housing body 2*m* that is generally in the shape of a box whose upper side (opening 3) is open (see a perspective view illustrated in FIG. 3), and an apparatus cover 2*c* that forms an upper surface of the apparatus housing 2 and is in the shape of a lid covering the opening (hereinafter referred to as a "body opening") 3 of the housing body 2*m*. As illustrated in FIG. 2, the apparatus cover 2*c* has an apparatus cover rotating shaft 4 that is provided at a rear end thereof, extending in the leftward/rightward direction, and is rotatably supported by a bearing (not illustrated) provided at an upper end of a rear end portion of the housing body 2*m*. As illustrated in FIG. 3, this allows the apparatus cover 2*c* to be opened when the front side of the apparatus cover 2*c* is rotated about the apparatus cover rotating shaft 4 (not illustrated in FIG. 3) in a direction away from the housing body 2*m*, and to be closed when the front side is rotated in a direction toward the housing body 2*m*. The image formation apparatus 1 is thus configured such that, when the apparatus cover 2*c* is open, the inside of the image formation apparatus 1 is exposed from the body opening 3 of the housing body 2*m* and can therefore be accessed.

A state of the apparatus cover 2*c* in which the body opening 3 is covered and completely closed by the apparatus cover 2*c* as illustrated in FIG. 1 is hereinafter referred to as a "closed state," and a state of the apparatus cover 2*c* in which the body opening 3 is fully open so that the inside of the image formation apparatus 1 is exposed as illustrated in FIG. 3 is hereinafter referred to as an "open state."

As illustrated in FIGS. 1 and 2, a portion of the upper surface of the apparatus cover 2*c* is recessed, and this recessed portion forms a stacker 5 on which sheets of paper are stacked (collected). In other words, the apparatus cover 2*c* has the stacker 5 at the upper surface, which is an outer peripheral portion of the apparatus cover 2*c*. The stacker 5 has a stack surface (i.e., a bottom surface) 5*s* on which sheets of paper are stacked. The stack surface 5*s* is sloped upward from the rear end to the front end. The image formation apparatus 1 is thus configured such that sheets of paper discharged forward from a paper discharge opening 6 provided at a rear wall surface 5*b* of the stacker 5 are stacked on the stack surface 5*s* of the stacker 5.

The apparatus cover 2*c* is also provided with a cover opening 7 at a rear portion of the stacker 5. The cover opening 7 is a hole that is elongated in the leftward/rightward direction and opens the rear portion of the stacker 5 and portions (hereinafter referred to as "left and right outer portions flanking the stacker 5") of the apparatus cover 2*c* that are located on both left and right sides of (i.e., outward of) the rear portion of the stacker 5.

In the image formation apparatus 1, when a fixation device 8 is removably attached to the housing body 2*m*, an upper surface of the fixation device 8 is exposed to the outside from the cover opening 7. The fixation device 8 is described in detail later. The upper surface of the fixation device 8 is shaped so as to block the cover opening 7, and to form the rear portion of the stacker 5 (i.e., a rear portion of the stack surface 5*s* of the stacker 5 and rear portions of a left and a right side wall surface 5*w* of the stacker 5) and the left and right outer portions flanking the stacker 5. The rear wall surface 5*b* of the stacker 5 is a portion of the housing body 2*m*. Thus, the stack surface 5*s* and the side wall surfaces 5*w* of the stacker 5 are formed by the apparatus cover 2*c* and the fixation device 8, and the rear wall surface 5*b* of the stacker 5 is formed by the housing body 2*m*.

Furthermore, handles 9 are provided on the upper surface of the fixation device 8 at the left and right outer portions flanking the stacker 5. As illustrated in a perspective view of FIG. 4, the image formation apparatus 1 is configured such that while the apparatus cover 2*c* remains in the closed state, the fixation device 8, which has been attached to the housing body 2*m*, can be removed from the housing body 2*m* through the cover opening 7 of the apparatus cover 2*c* by holding and pulling upward the handles 9, which are exposed from the cover opening 7 of the apparatus cover 2*c*. The image formation apparatus 1 is also configured such that the fixation device 8 is lifted up with the handles 9 grasped, and is inserted through the cover opening 7 of the apparatus cover 2*c*, whereby the fixation device 8 can be attached to the housing body 2*m* through the cover opening 7 of the apparatus cover 2*c*.

A control unit 10 that controls the entire image formation apparatus 1 is also provided at a predetermined position in the housing body 2*m*. Although not illustrated in FIG. 1, a display panel that can be controlled by a touch operation and displays various kinds of information, various operation buttons, and the like are provided at predetermined sites of the housing body 2*m* or the apparatus cover 2*c*.

Next, an internal configuration of the image formation apparatus 1 is described. As illustrated in FIG. 2, parts are arranged in the apparatus housing 2 along a conveyance path R along which paper M is conveyed. Specifically, in the apparatus housing 2, four image formation units 20 (20K, 20Y, 20M, 20C) corresponding to a plurality of color developers (e.g., four color toners of black (K), yellow (Y), magenta (M), and cyan (0)) that are used in the image formation apparatus 1 are provided at almost the middle in the upward/downward direction, and are arranged side by side along the conveyance path R in the forward/backward direction.

Each image formation unit 20 (20K, 20Y, 20M, 20C) includes an LED head 21 (21K, 21Y, 21M, 21C), a photosensitive drum 22 (22K, 22Y, 22M, 22C), and a toner container 23 (23K, 23Y, 23M, 23C). Each image formation unit 20 is a hardware device in which a surface of the photosensitive drum 22 is exposed to light emitted by the LED head 21 so that an electrostatic latent image is formed on the surface of the photosensitive drum 22, and thereafter, toner supplied from the toner container 23 is caused to adhere to the electrostatic latent image, whereby a toner image is formed on the surface of the photosensitive drum 22.

In the apparatus housing 2, a transfer unit 24 is also provided below the four image formation units 20. The transfer unit 24 has a loop of conveyance belt 25 that is movable along the conveyance path R in the forward/backward direction, and transfer rollers 26 (26K, 26Y, 26M, 26C) that are provided below the photosensitive drums 22 (22K, 22Y, 22M, 22C), facing the photosensitive drums 22 (22K, 22Y, 22M, 22C) with the conveyance belt 25 interposed therebetween.

Each transfer roller 26 is a member that electrostatically charges paper M to the polarity opposite to that of the toner while the paper M is being passed between the photosensitive drum 22 and the conveyance belt 25 so that a toner image of the corresponding color formed on the photosensitive drum 22 is transferred to the paper M.

In the apparatus housing 2, a paper tray 27 that contains paper M is also provided below the transfer unit 24 (i.e., at a lower portion of the apparatus housing 2). In the apparatus housing 2, a pair of transfer rollers that convey paper M, and the like, are also provided on the conveyance path R between the paper tray 27 and the transfer unit 24.

In the apparatus housing 2, the fixation device 8 is also provided downstream of (i.e., at the back of) the transfer unit 24 in a paper conveyance direction. The fixation device 8 includes a hot roller 28, and a backup roller 29 that is provided below the hot roller 28, facing the hot roller 28 with the conveyance path R interposed therebetween. The fixation device 8 fixes a toner image transferred to paper M by the transfer unit 24 to the paper M by heating and pressurization using the hot roller 28 and the backup roller 29.

In the apparatus housing 2, a pair of discharge rollers that discharges paper M to the stacker 5 through the paper discharge opening 6 is provided on the conveyance path R between the fixation device 8 and the paper discharge opening 6. The image formation apparatus 1 has the internal configuration described above.

As illustrated in FIG. 2, parts other than the paper tray 27 of the image formation apparatus 1 are tilted with respect to a bottom surface of the apparatus housing 2. For example, the four image formation units 20 and the fixation device 8 are each tilted with respect to the bottom surface of the apparatus housing 2 toward the front of the apparatus housing 2, and therefore; are located at different positions or heights in the upward/downward direction. The image formation apparatus 1 is thus configured such that a length in the forward/backward direction of the apparatus housing 2 can be reduced compared to the case where parts other than the paper tray 27 are arranged in parallel to the bottom surface of the apparatus housing 2.

2. Configurations of Fixation Device and Surrounding Parts

Next, configurations of the fixation device 8 and surrounding parts are described in greater detail. Here, of the configurations of the fixation device 8 and surrounding parts, only configurations of parts involved in attachment and removal of the fixation device 8 are described.

Figure 5:
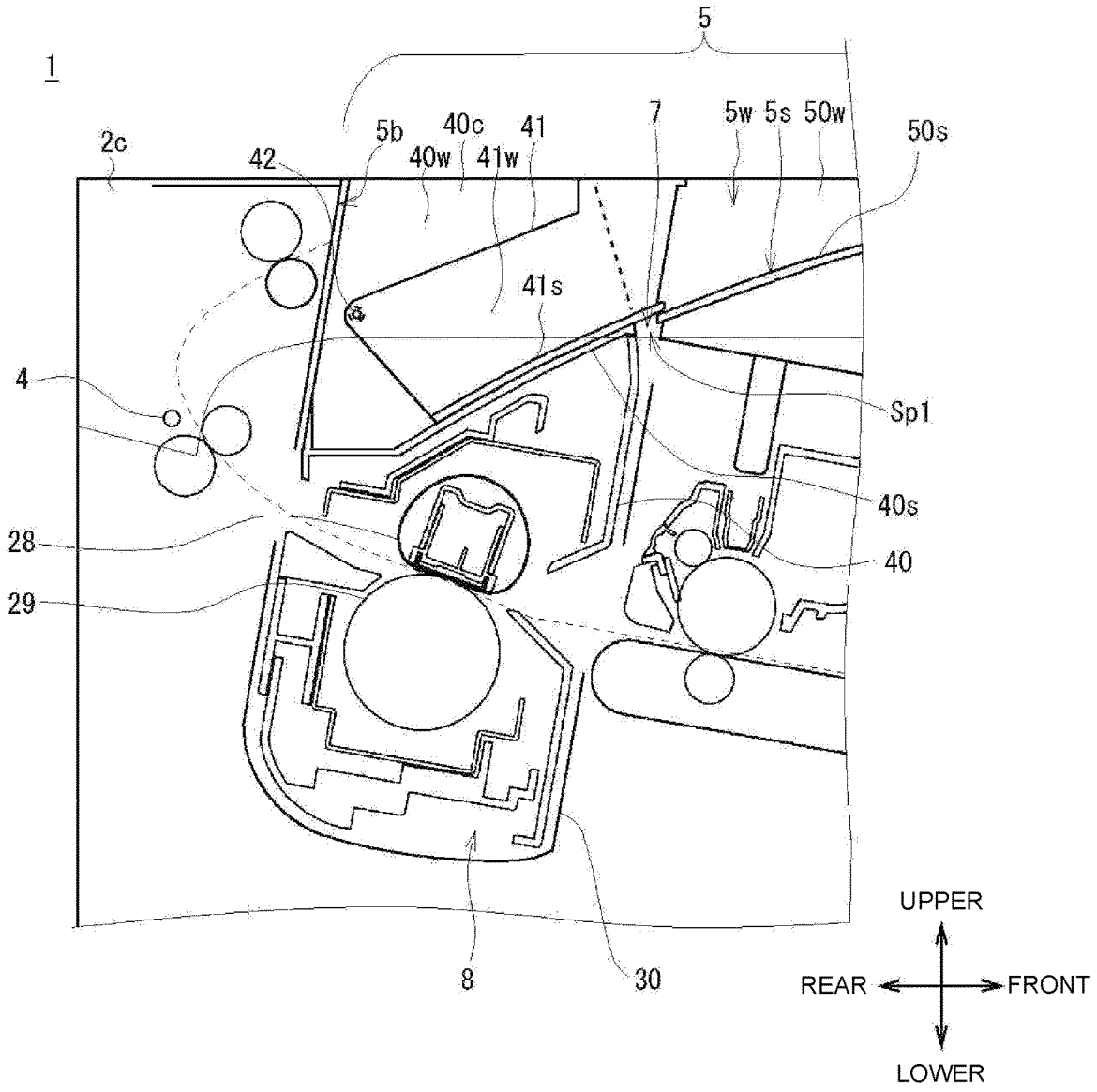
FIG. 5 is an enlarged cross-sectional view of configurations of the fixation device and surrounding parts.

FIG. 5 illustrates configurations of the fixation device 8 and surrounding parts, FIG. 5 is an enlarged cross-sectional view illustrating configurations of the fixation device 8 and surrounding parts with the apparatus cover 2*c* in the closed state and the fixation device 8 attached to the housing body 2*m*.

As illustrated in FIG. 5, in the housing body 2*m*, a fixation device compartment 30 in which the fixation device 8 is removably contained is provided below the cover opening 7 of the apparatus cover 2*c* as it is in the closed state.

Figure 4:
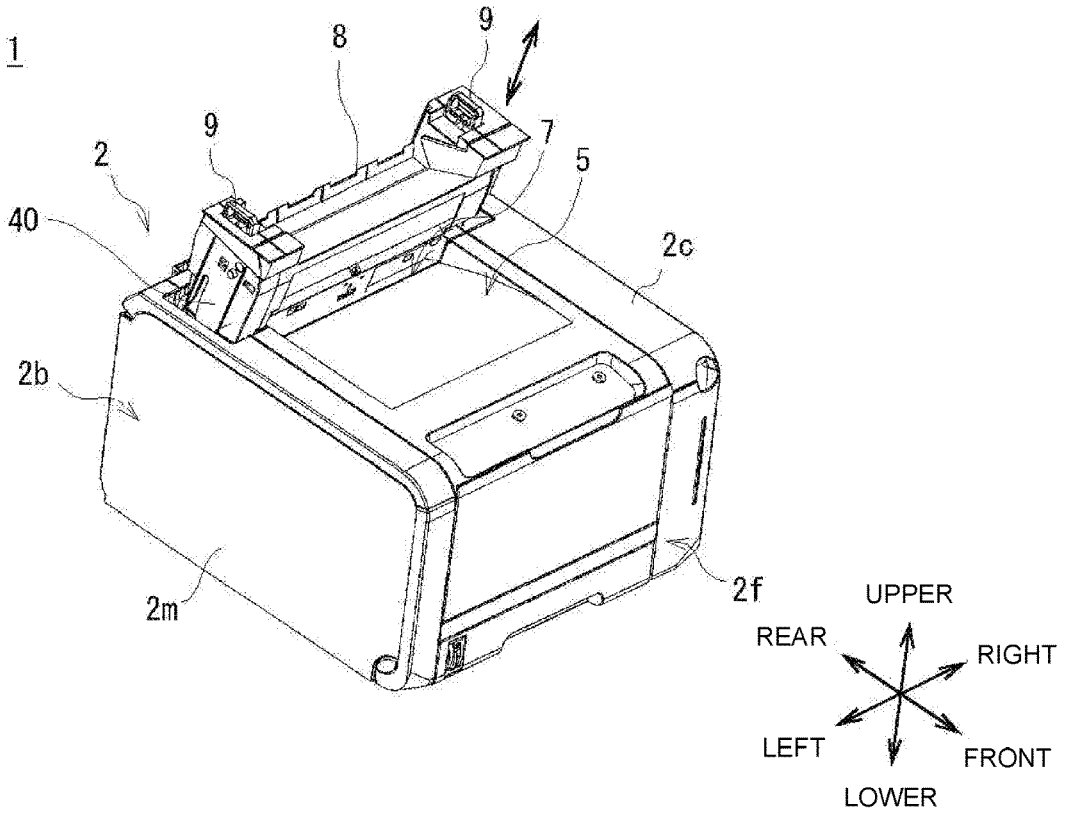
FIG. 4 is a perspective view illustrating an appearance or external configuration of the image formation apparatus with a fixation device removed.

As illustrated in FIG. 4 in addition to FIG. 5, the fixation device 8 has, as a cover, a fixation device housing 40 that is generally in the shape of a rectangular parallelepiped and is elongated in the leftward/rightward direction. The fixation device housing 40 is configured to be contained in the fixation device compartment 30 of the housing body 2*m* with an upper surface thereof exposed to the outside from the cover opening 7. Note that the fixation device compartment 30 is configured to contain the fixation device housing 40 with the fixation device housing 40 tilted forward. Due to this, the fixation device housing 40 is configured to be pulled forward and diagonally upward in order to remove the fixation device 8 from the image formation apparatus 1, and is configured to be inserted backward and diagonally downward in order to attach the fixation device 8 to the image formation apparatus 1.

The fixation device housing 40 has an upper surface that is elongated in the leftward/rightward direction and serves as an exposed portion. The upper surface is formed by a fixation device cover 40*c*. The fixation device cover 40*c* is recessed at a middle portion thereof in the leftward/rightward direction. This recessed portion forms a rear portion of the stacker 5 (i.e., rear portions of the stack surface 5*s* and the left and right side wall surfaces 5*w*).

A portion 40*s* of the entire fixation device cover 40*c* that forms the stack surface 5*s* of the stacker 5 is herein referred to as a "stack surface formation portion 40*s*," and portions 40*w* of the entire fixation device cover 40*c* that form the side wall surfaces 5*w* are herein referred to as "side wall surface formation portions 40*w*." Meanwhile, a portion 50*s* of the entire apparatus cover 2*c* that forms a front portion of the stack surface 5*s* of the stacker 5 is referred to as a "stack surface formation portion 50*s*," and portions 50*w* of the entire apparatus cover 2*c* that form front portions of the left and right side wall surfaces 5*w* of the stacker 5 are referred to as "side wall surface formation portions 50*w*."

The stack surface formation portion 40*s* and the side wall surface formation portions 40*w* of the fixation device cover 40*c* are flush with the stack surface formation portion 50*s* and the side wall surface formation portions 50*w*, respectively, of the apparatus cover 2*c*. The stack surface formation portion 40*s* and the side wall surface formation portions 40*w* of the fixation device cover 40*c*, and the stack surface formation portion 50*s* and the side wall surface formation portions 50*w* of the apparatus cover 2*c*, form the stacker 5.

Furthermore, the fixation device cover 40*c* is provided with the handle 9 (FIG. 1) at each of the left and right outer portions franking the stacker 5. As illustrated in FIG. 4, the left and right handles 9 can be rotated and transitioned between an upright position in which the handle 9 stands and protrudes upward from the fixation device cover 40*c*, and a laid-flat position in which the handle 9 is tilted toward the middle in the leftward/rightward direction (inward in a longitudinal direction of the upper surface of the fixation device housing 40) until it is laid flat so as to be contained in the fixation device cover 40*c* as illustrated in FIG. 1. The user, when attaching and removing the fixation device 8, can turn the left and right handles 9 into the upright position, and then grasp the left and right handles 9. Configurations of the handle 9 and surrounding parts are described in greater detail later.

In addition to the fixation device cover 40*c*, a sub-cover 41 is attached to the upper surface of the fixation device housing 40. The sub-cover 41 is configured to cover a gap Sp1 between a front end of the stack surface formation portion 40*s* of the fixation device housing 40 as it is contained in the fixation device compartment 30, and a rear end of the stack surface formation portion 50*s* of the apparatus cover 2*c* as it is in the closed state. The sub-cover 41 is attached to the fixation device cover 40*c*, covering a front portion of the fixation device cover 40*c*. That is, a front portion of the upper surface of the fixation device housing 40 has a double structure including the fixation device cover 40*c* and the sub-cover 41. The fixation device cover 40*c* and the sub-cover 41 form a rear portion of the stacker 5. A portion 41*s* of the entire sub-cover 41 that forms the stack surface 5*s* of the stacker 5 is herein referred to as a "stack surface formation portion 41*s*," and portions 41*w* of the entire sub-cover 41 that form the side wall surfaces 5*w* are herein referred to as "side wall surface formation portions 41*w*."

The sub-cover 41 has a sub-cover rotating shaft 42 that is provided at rear ends of the left and right side wall surface formation portions 41*w*, extending in the leftward/rightward direction. The sub-cover rotating shaft 42 is rotatably supported by bearing parts (not illustrated) provided at rear portions of the side wall surface formation portions 40*w* of the fixation device cover 40*c*. This allows the sub-cover 41 to be opened by rotation about the sub-cover rotating shaft 42 in a direction (anticlockwise direction in FIG. 5) that causes the stack surface formation portion 41*s* of the sub-cover 41 to move away from the stack surface formation portion 40*s* of the fixation device cover 40*c*, and to be closed by rotation in a direction (clockwise direction in FIG. 5) that causes the stack surface formation portion 41*s* of the sub-cover 41 to move toward the stack surface formation portion 40*s* of the fixation device cover 40*c*.

Furthermore, the sub-cover 41 is pressed by a pressing member (not illustrated) in a direction that causes the stack surface formation portion 41*s* of the sub-cover 41 to move toward the stack surface formation portion 40*s* of the fixation device cover 40*c* (i.e., in a direction that causes the sub-cover 41 to be closed).

The sub-cover 41 is also configured such that a front end portion of the stack surface formation portion 41*s* overlays the stack surface formation portion 50*s* of the apparatus cover 2*c*, and therefore, when the apparatus cover 2*c* is opened, the stack surface formation portion 41*s* of the sub-cover 41 is pressed upward by the stack surface formation portion 50*s* of the apparatus cover 2*c*, so that the sub-cover 41 is opened together with the apparatus cover 2*c*. When the apparatus cover 2*c* is closed, the sub-cover 41 is closed together with the apparatus cover 2*c* due to a pressing force of the pressing member. Thus, the sub-cover 41 is configured to cover the gap Sp1 and to be opened and closed together with the apparatus cover 2*c* when the apparatus cover 2*c* is opened and closed.

Figure 6A:
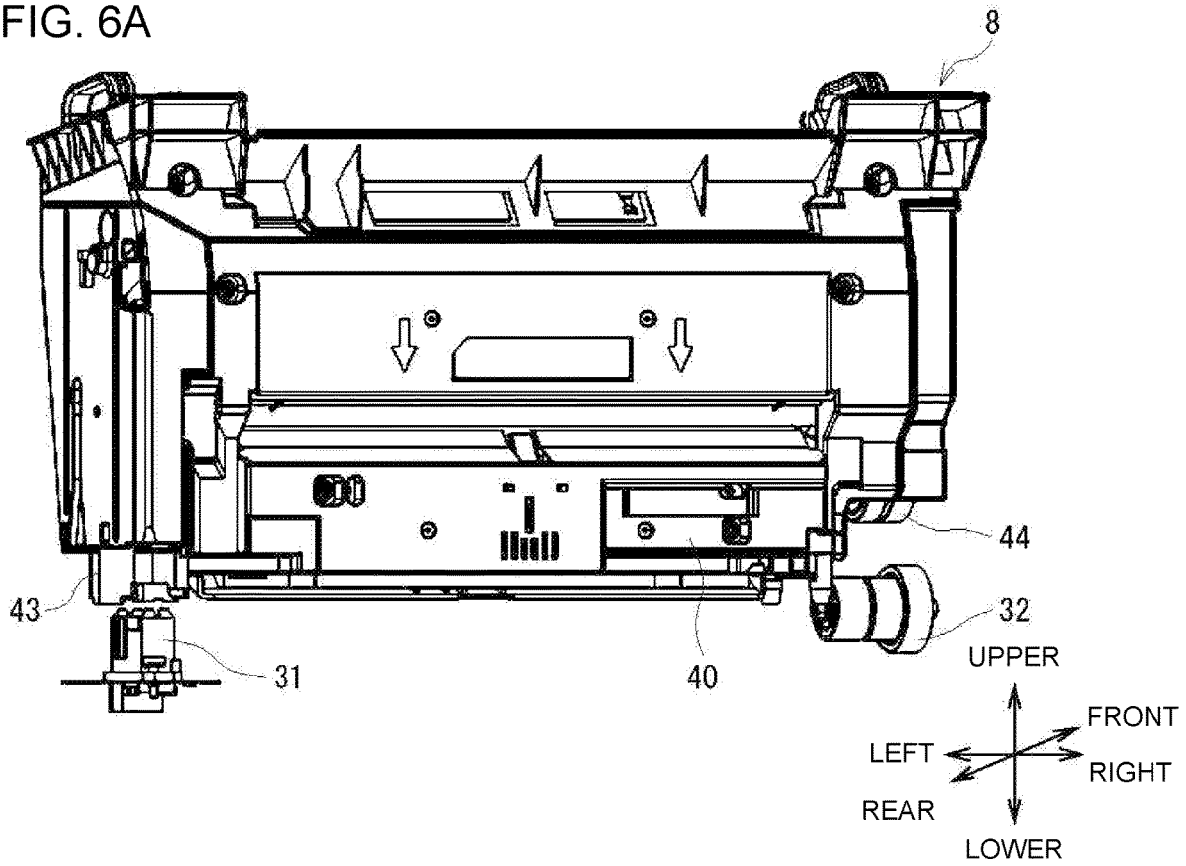
FIGS. 6A and 6B are perspective views illustrating an appearance or external configuration of the fixation device as viewed from the front.

As illustrated in FIG. 6A, which is a perspective view illustrating an appearance of the fixation device 8 as viewed from the front, a connector 43 is provided at one end (e.g., a left end) in the longitudinal direction (leftward/rightward direction) of a lower end portion of the fixation device housing 40, protruding downward. A gear part 44 is provided at the other end (e.g., a right end) in the longitudinal direction of the lower end portion of the fixation device housing 40, protruding downward.

Figure 6B:
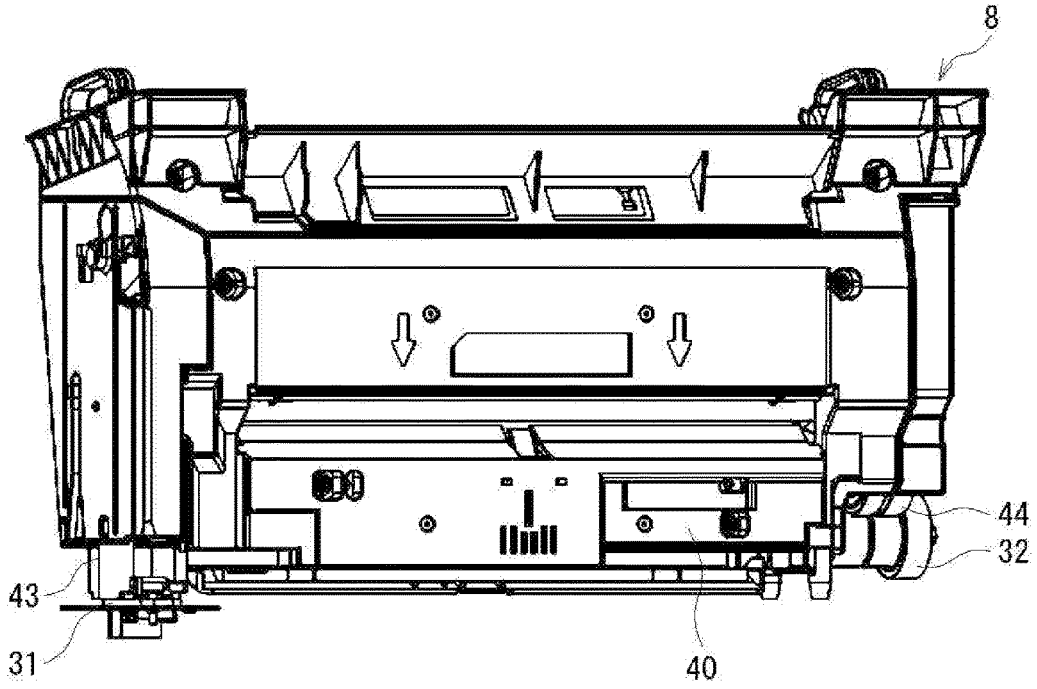

As illustrated in FIG. 6B, when the fixation device housing 40 is contained in the fixation device compartment 30, the connector 43 of the fixation device housing 40 is mated to a connector 31 provided at a bottom portion of the fixation device compartment 30 from above. When the connector 43 is mated to the connector 31, the fixation device 8 can be supplied with power from the image formation apparatus 1, and can exchange various signals with the image formation apparatus 1. When the fixation device housing 40 is contained in the fixation device compartment 30, the gear part 44 of the fixation device housing 40 is engaged with a gear part 32 provided at a bottom portion of the fixation device compartment 30 from above. When the gear part 44 is mated to the gear part 32, the fixation device 8 can be supplied with a drive force from the image formation apparatus 1.

3. Configurations of Handle and Surrounding Parts

Figure 7B:
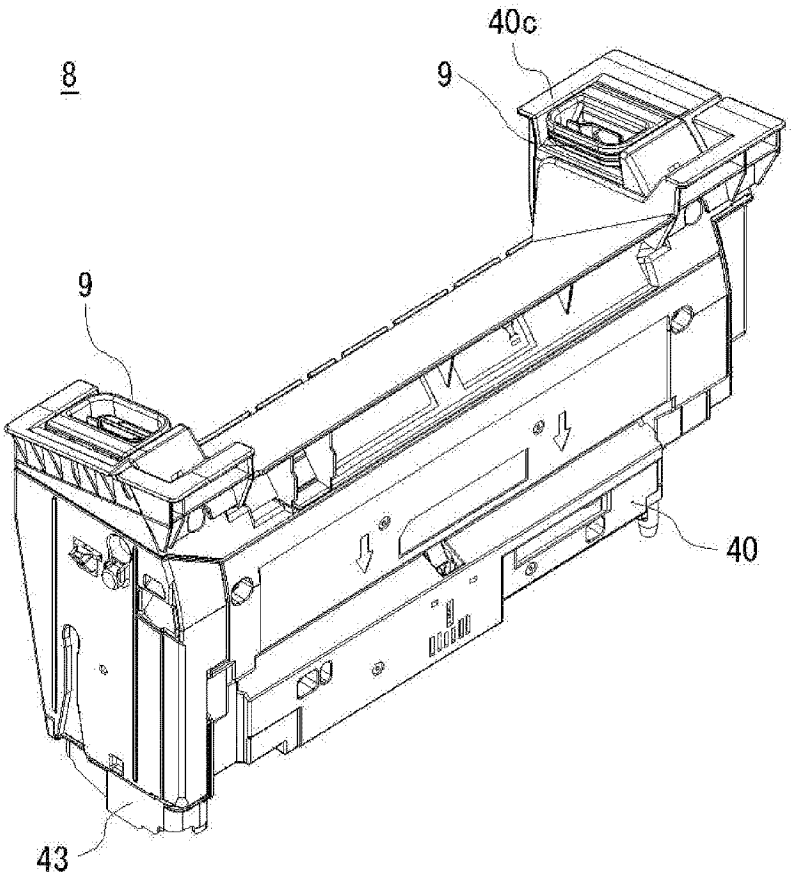
FIGS. 7A and 7B are front perspective views illustrating an appearance or external configuration of the fixation device as viewed obliquely from above.
Figure 7A:
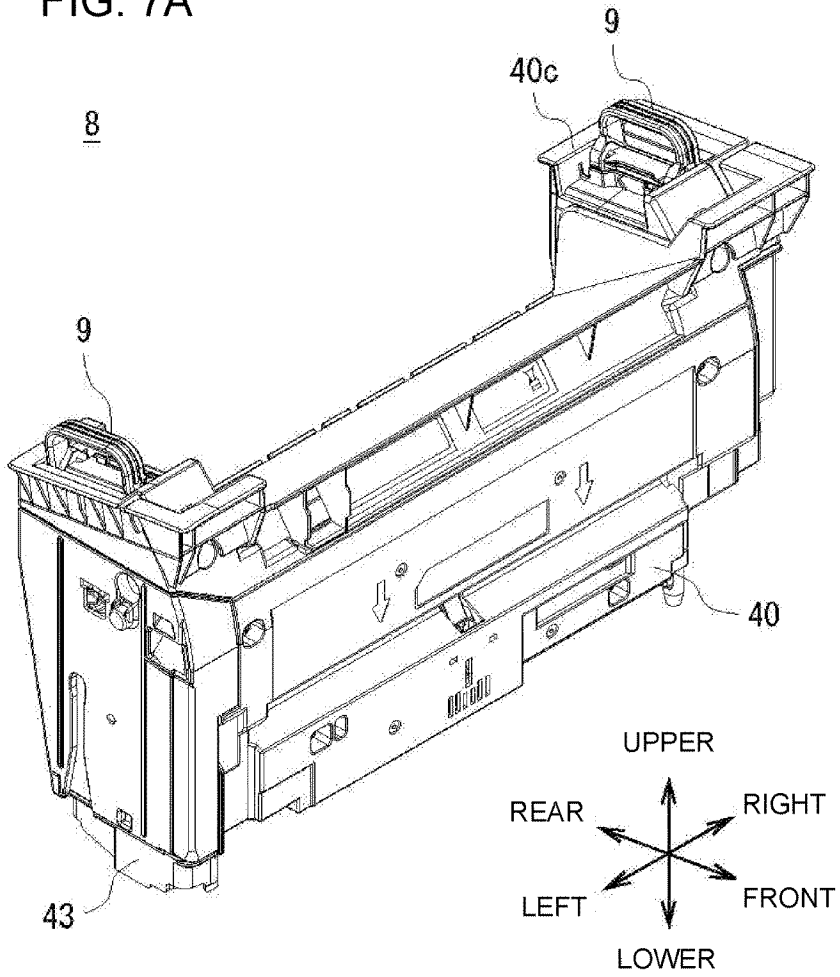

Next, the handle 9 and surrounding parts of the fixation device 8 are described in greater detail. As illustrated in FIGS. 7A and 7B, which are front perspective views of an appearance of the fixation device 8 as viewed obliquely from above, one handle 9 is provided at each of a left and a right side portion of the fixation device cover 40*c* (i.e., a left and a right portions of an upper end portion of the fixation device housing 40). In FIG. 7A, the handle 9 is in an upright position. In FIG. 7B, the handle 9 is in a laid-flat position. The left and right handles 9 are laterally symmetrical, and have the same basic configuration, and therefore, the left handle 9 is here mainly described.

Figure 8B:
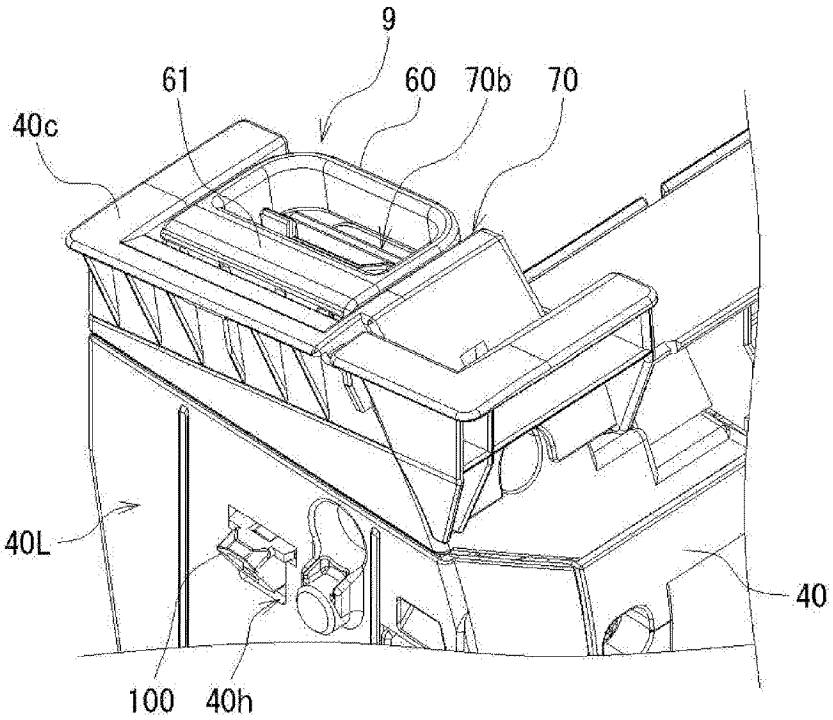
FIGS. 8A and 8B are enlarged perspective views illustrating an appearance or external configuration of a left handle and surrounding parts.
Figure 8A:
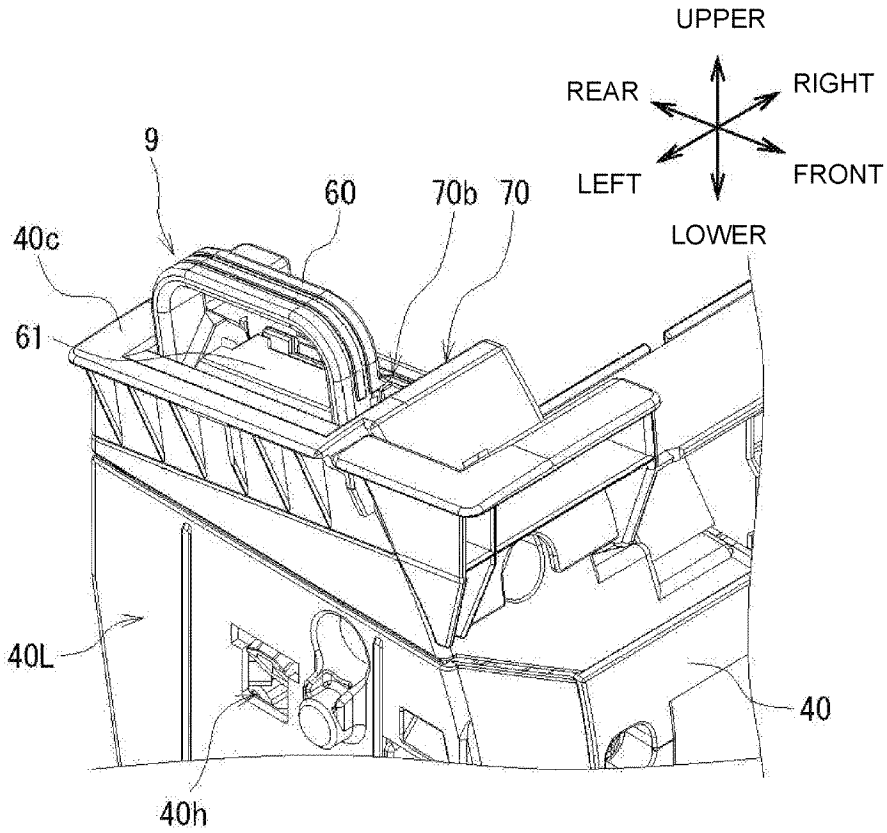
Figure 9A:
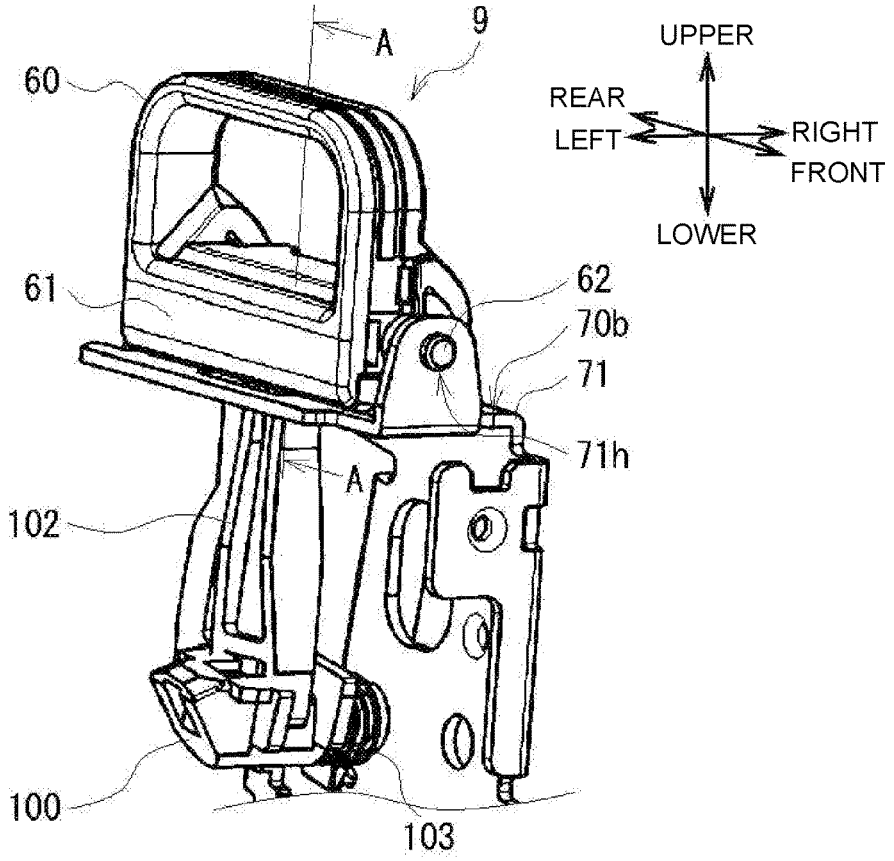
FIGS. 9A and 9B are enlarged perspective views illustrating an internal configuration of the left handle and surrounding parts.
Figure 9B:
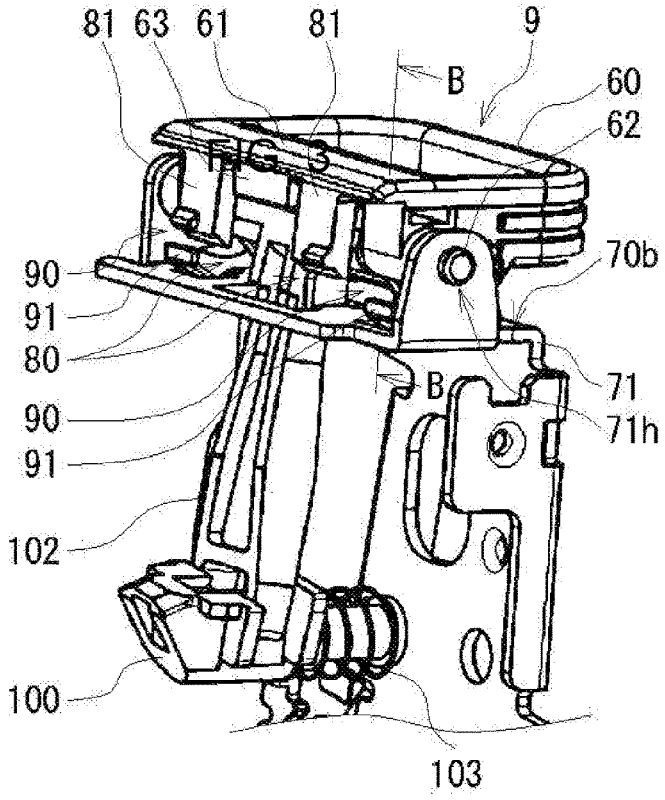

Here, FIGS. 8A and 8B illustrate an appearance or external configuration of the handle 9, and an appearance or external configuration of surrounding parts. FIGS. 9A and 9B illustrate an appearance or external configuration of the handle 9, and an internal configuration of surrounding parts. In FIGS. 8A and 9A, the handle 9 is in the upright position. In FIGS. 8B and 9B, the handle 9 is in the laid-flat position.

As illustrated in FIGS. 8A, 8B, 9A, and 9B, the handle 9 includes a grasp section 60 that is generally in the shape of a squared C and configured to be grasped by the user, and an attachment section 61 that extends from one end of the squared-C shape of the grasp section 60 to the other end and configured to be attached to the fixation device housing 40. The handle 9 is generally in the shape of D as a whole, and therefore, has an annular shape. The handle 9 is also provided with a rotating shaft 62 at the attachment section 61. The rotating shaft 62 extends in a direction in which the attachment section 61 extends. The rotating shaft 62 protrudes from both ends in the extending direction of the attachment section 61.

As illustrated in FIGS. 8A and 8B, the attachment section 61 of the handle 9 is attached to a left end of a recessed section 70 that has almost the same size as that of the handle 9 and is provided at a left portion of an upper end portion of the fixation device housing 40 with the rotating shaft 62 (see FIGS. 9A and 9B) oriented in the forward/backward direction. Here, as illustrated in FIGS. 9A and 9B, the rotating shaft 62, which protrudes from the front and rear ends of the attachment section 61, is inserted through respective shaft holes 71*h* that are provided at a frame 71 of the fixation device housing 40 and are located on a front and a rear side of the recessed section 70. Thus, the attachment section 61 of the handle 9 is supported by the frame 71 of the fixation device housing 40 in a manner that allows the attachment section 61 to rotate about the rotating shaft 62, which extends in the forward/backward direction.

The handle 9, which rotates about the rotating shaft 62, can be transitioned between the upright position and the laid-flat position. Here, as illustrated in FIG. 8A, the upright position with respect to the handle 9 means that the handle 9 stands in substantially a vertical position with respect to a bottom surface 70*b* of the recessed section 70 (i.e., the upper surface of the fixation device housing 40) with the grasp section 60 located above the attachment section 61. As illustrated in FIG. 8B, the laid-flat position with respect to the handle 9 means that the handle 9 is laid flat to be substantially parallel to the bottom surface 70*b* of the recessed section 70 with the grasp section 60 located on the right side of the attachment section 61, and the handle 9 is substantially entirely contained in the recessed section 70.

As illustrated in FIG. 9B, the handle 9 and the frame 71 of the fixation device housing 40 also have a detent mechanism (hereinafter referred to as an "upright position-keeping detent mechanism") 80 for keeping the handle 9 in the upright position, and a detent mechanism (hereinafter referred to as a "laid-flat position-keeping detent mechanism") 90 for keeping the handle 9 in the laid-flat position. Here, the upright position-keeping detent mechanism 80 and the laid-flat position-keeping detent mechanism 90 are described in sequence.

Figure 10A:
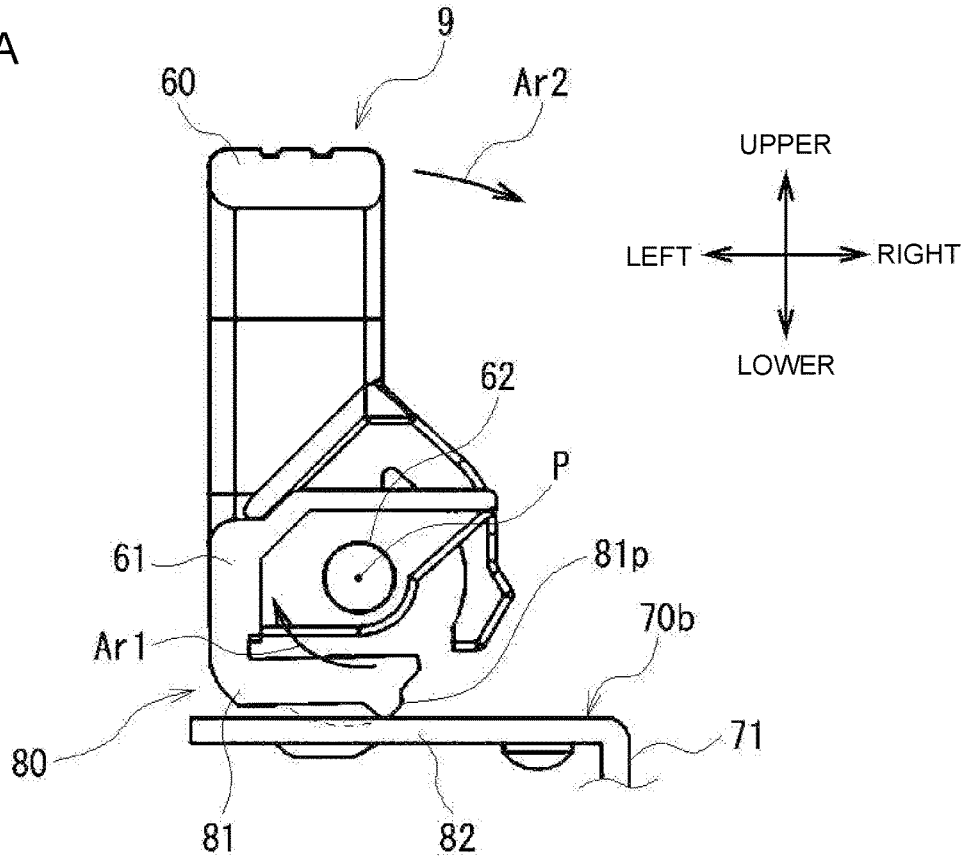
FIGS. 10A and 10B are cross-sectional views taken along line A-A of FIG. 9A.

As illustrated in FIG. 9B, and in addition, FIG. 10A, which is a cross-sectional view of the handle 9 and the frame 71 taken along line A-A of FIG. 9A, the upright position-keeping detent mechanism 80 includes an upright position-keeping arm 81 that is provided at the attachment section 61 of the handle 9, and an upright position-keeping arm engagement section 82 that is provided at the frame 71 of the fixation device housing 40.

There are two of the upright position-keeping arms 81 that are located at a middle portion in an axial direction of the attachment section 61 with a space therebetween in the axial direction. The two upright position-keeping arms 81 are a cantilever plate spring that, when the handle 9 is in the upright position, is located at a lower end (below the rotating shaft 62) of the attachment section 61, extending from a left end toward a right end of the lower end of the attachment section 61 (from the outside toward the inside in the longitudinal direction of the fixation device housing 40 (FIG. 7)).

In other words, the two upright position-keeping arms 81 are a cantilever plate spring member that, when the handle 9 is in the upright position, is located at the lower end of the attachment section 61, extending from the left end of the lower end of the attachment section 61 in a direction opposite to the direction of rotation of the handle 9 that occurs when the handle 9 is rotated and transitioned from the upright position to the laid-flat position (clockwise direction indicated by an arrow Ar1 in FIG. 10A).

A tip of the upright position-keeping arm 81 is located rightward of a center P of the rotating shaft 62 (further inside in the longitudinal direction of the upper surface of the fixation device housing 40 than is the center P). The tip of the upright position-keeping arm 81 is provided with a protrusion 81*p* protruding downward.

Meanwhile, there are two of the upright position-keeping arm engagement sections 82 that are located below a middle portion in the axial direction of the attachment section 61 with a space therebetween in the axial direction. The two upright position-keeping arm engagement sections 82 are flat sections that, when the handle 9 is in the upright position, are located below the two upright position-keeping arms 81, and form a portion of the bottom surface 70*b* of the recessed section 70.

As illustrated in FIG. 10A, the upright position-keeping arm 81 is configured such that, when the handle 9 is in the upright position, the protrusion 81*p* is in contact with the upright position-keeping arm engagement section 82 to keep the handle 9 in the upright position. Specifically, at this time, the handle 9 is restrained from rotating in the clockwise direction indicated by the arrow Ar1 in FIG. 10A, by the upright position-keeping arm engagement section 82 being located inside a movement path (closer to the rotating shaft 62) of the protrusion 81*p* indicated by a dashed line in FIG. 10A, and is thereby kept in the upright position.

Figure 10B:
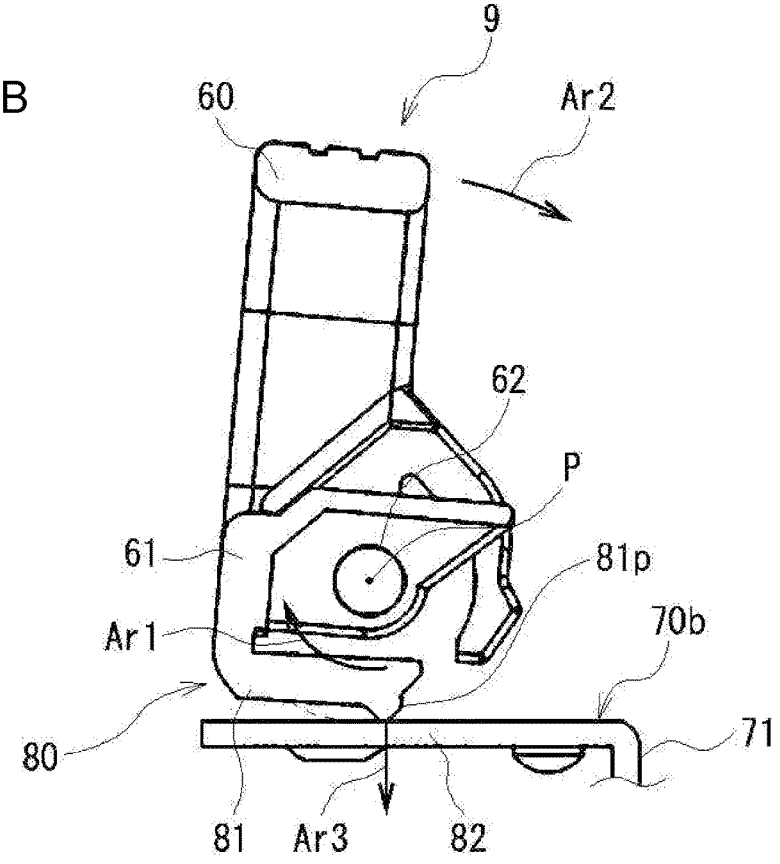

Here, for example, when the user applies at least a predetermined force to the handle 9 in a tilting direction indicated by an arrow Ar2 in order to rotate and transition the handle 9 from the upright position to the laid-flat position (a first predetermined force), the upright position-keeping arm 81 is bent in a direction that causes the tip thereof to move toward the rotating shaft 62 as illustrated in FIG. 198. As a result, the upright position-keeping arm engagement section 82 is located outside the movement path of the protrusion 81*p*, which allows the handle 9 to rotate clockwise as illustrated in FIG. 10B with the protrusion 81*p* being slid on the upright position-keeping arm engagement section 82. At this time, the protrusion 81*p* is pressed against the underlying upright position-keeping arm engagement section 82 by the elastic force of the upright position-keeping arm 81, and therefore, a downward pressing force indicated by an arrow Ar3 is applied to the upright position-keeping arm engagement section 82.

When the protrusion 81*p* of the upright position-keeping arm 81 is moved to a position located leftward of the center P of the rotating shaft 62, past the upright position-keeping arm engagement section 82, the handle 9 is no longer kept in the upright position, and continues to be moved in the clockwise direction indicated in FIG. 10B, Specifically, the keeping of the handle 9 in the upright position ends when the handle 9 has been rotated from the upright position by about 10 degrees in the clockwise direction indicated in FIG. 10B.

Thus, the upright position-keeping detent mechanism 80 can keep the handle 9 in the upright position, and when at least the predetermined force (i.e., a force that can move the protrusion 81*p* to a position leftward of the rotating shaft 62) is applied to the handle 9 in a direction that causes the handle 9 to tilt, can end the keeping of the handle 9 in the upright position, and allow the handle 9 to rotate and transition to the laid-flat position.

When the handle 9 is transitioned from the laid-flat position to the upright position, the upright position-keeping detent mechanism 80 operates in an opposite manner to that in the transition from the upright position to the laid-flat position. Specifically, when the handle 9 is rotated in the direction that causes the handle 9 to stand up until the handle 9 is very close to the upright position, the upright position-keeping arm 81 is in contact with the upright position-keeping arm engagement section 82. In this situation, if the user applies at least a predetermined force to the handle 9 in the direction that causes the handle 9 to stand up (a second predetermined force), the upright position-keeping arm 81 is bent in the direction that causes the tip to move toward the rotating shaft 62. As a result, the upright position-keeping arm engagement section 82 is located outside the movement path of the protrusion 81*p*, which allows the handle 9 to rotate with the protrusion 81*p* being slid on the upright position-keeping arm engagement section 82. At this time, the protrusion 81$p$ is also pressed against the underlying upright position-keeping arm engagement section 82 by the elastic force of the upright position-keeping arm 81, and therefore, the downward pressing force indicated by the arrow Ar3 is applied to the upright position-keeping arm engagement section 82.

When the protrusion 81$p$ of the upright position-keeping arm 81 is moved to a position rightward of the center P of the rotating shaft 62, so that the handle 9 is transitioned to the upright position, the upright position-keeping arm 81 is moved past the upright position-keeping arm engagement section 82 to return to an original shape thereof, so that the handle 9 is kept in the upright position.

Thus, if, when the handle 9 is very close to the upright position, at least the predetermined force (i.e., a force that can cause the protrusion 81$p$ to move to a position rightward of the rotating shaft 62) is applied to the upright position-keeping detent mechanism 80 in the direction that causes the handle 9 to stand up, the handle 9 is rotated and transitioned to the upright position, and is then kept in the upright position.

Next, the laid-flat position-keeping detent mechanism 90 is described. As illustrated in FIG. 9B, and in addition, FIG. 11A, which is a cross-sectional view of the handle 9 and the frame 71 taken along line B-B of FIG. 9B, the laid-flat position-keeping detent mechanism 90 includes a laid-flat position-keeping arm 91 provided at the attachment section 61 of the handle 9, and a laid-flat position-keeping arm engagement section 92 provided at the frame 71 of the fixation device housing 40.

There are two of the laid-flat position-keeping arms 91 that are provided at both ends in the axial direction of the attachment section 61 (i.e., axially outward of the upright position-keeping arms 81). The two laid-flat position-keeping arms 91 are a cantilever plate spring that, when the handle 9 is in the laid-flat position, is located at the lower end (below the rotating shaft 62) of the attachment section 61, extending from a right end toward a left end of the lower end of the attachment section 61 (from the inside toward the outside in the longitudinal direction of the fixation device housing 40).

Figure 11A:
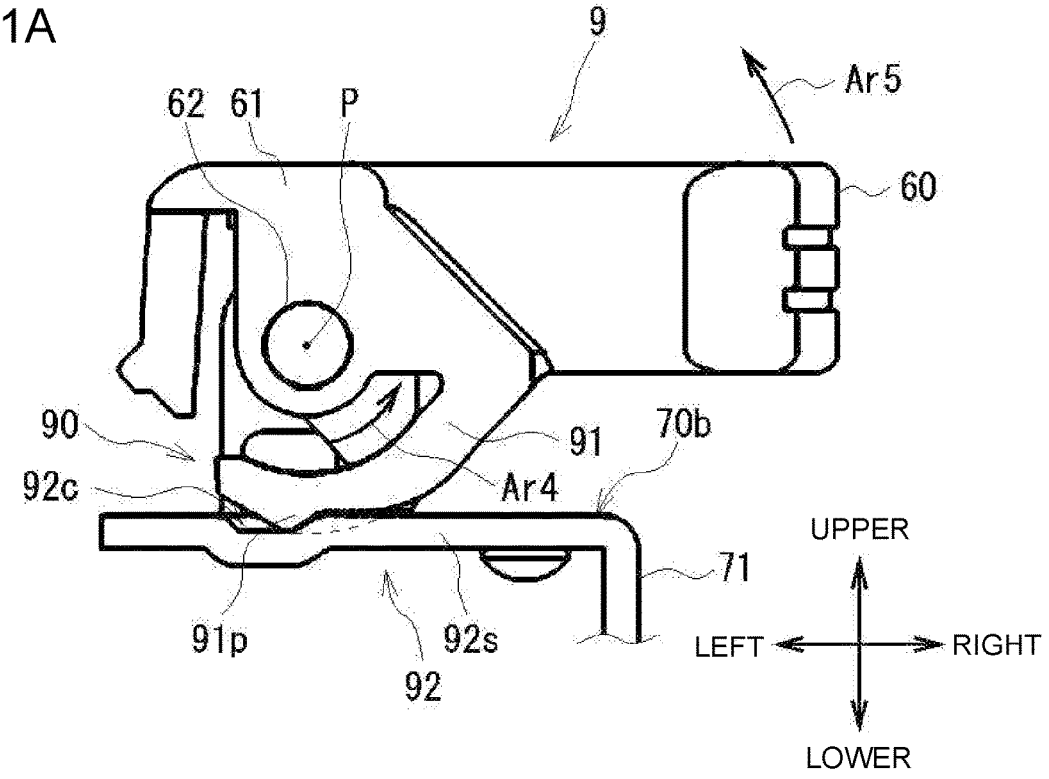
FIGS. 11A and 11B are cross-sectional views taken along line B-B of FIG. 9B.

In other words, the two laid-flat position-keeping arms 91 are a cantilever plate spring member that, when the handle 9 is in the laid-flat position, is located at the lower end of the attachment section 61, and extends from a right end of the lower end of the attachment section 61 in the direction opposite to the direction of rotation of the handle 9 that occurs when the handle 9 is transitioned from the laid-flat position to the upright position (anticlockwise direction indicated by an arrow Ar4 of FIG. 11A).

A tip of the laid-flat position-keeping arm 91 is located leftward of the center P of the rotating shaft 62 (outward of the center P in the longitudinal direction of the upper surface of the fixation device housing 40). The Up of the laid-flat position-keeping arm 91 is provided with a protrusion 91$p$ protruding downward.

Meanwhile, there are two of the laid-flat position-keeping arm engagement sections 92 below both ends in the axial direction of the attachment section 61. When the handle 9 is in the laid-flat position, the two laid-flat position-keeping arm engagement sections 92 are located below the two laid-flat position-keeping arms 91. The two laid-flat position-keeping arm engagement sections 92 include a flat section 92$s$ that forms a portion of the bottom surface 70$b$ of the recessed section 70 (see FIG. 8B), and a recessed section 92$c$ that is formed in the flat section 92$s$.

As illustrated in FIG. 11A, when the handle 9 is in the laid-flat position, the protrusion 91$p$ of the laid-flat position-keeping arm 91 is inserted in the recessed section 92$c$ of the laid-flat position-keeping arm engagement section 92, whereby the laid-flat position is kept, Specifically, at this time, a wall at a right end of the recessed section 92$c$ of the laid-flat position-keeping arm engagement section 92 is located inside a movement path (closer to the rotating shaft 62) (indicated by a dashed line in FIG. 11A) of the protrusion 91$p$, As a result, the handle 9 is restrained from rotating in the anticlockwise direction indicated by the arrow Ar4 in FIG. 11A, and is thereby kept in the laid-flat position.

Figure 11B:
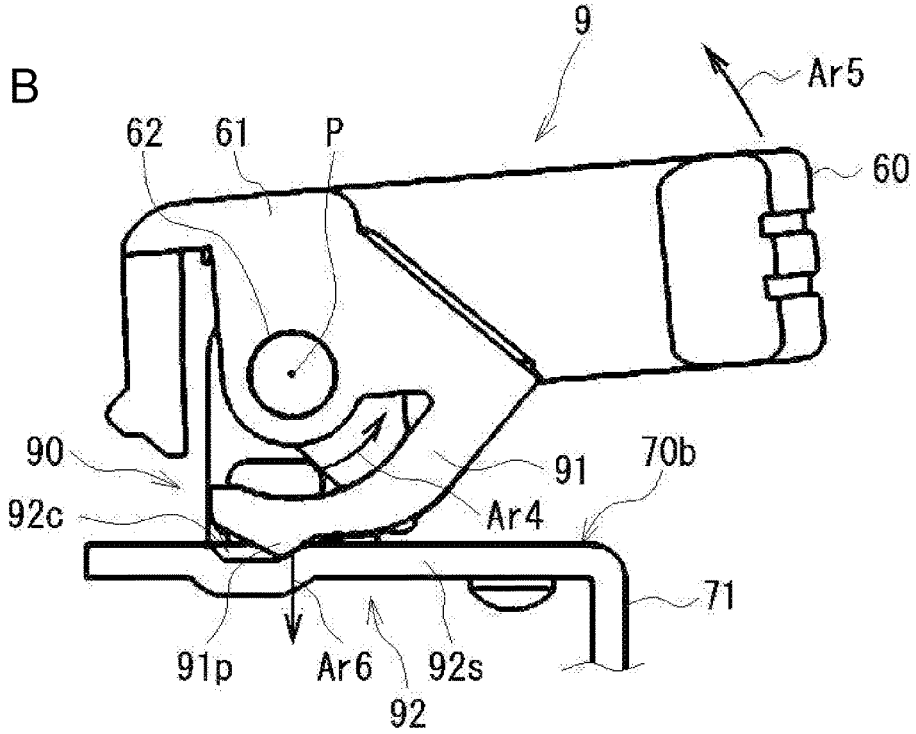

Here, for example, when the user applies at least the predetermined force to the handle 9 in the direction indicated by an arrow Ar5 that causes the handle 9 to stand up in order to rotate and transition the handle 9 from the laid-flat position to the upright position, the laid-flat position-keeping arm 91 is bent in the direction that causes the tip thereof to move toward the rotating shaft 62 as illustrated in FIG. 11B. When the handle 9 is further rotated until the protrusion 91$p$ of the laid-flat position-keeping arm 91 moves past the wall at the right end of the recessed section 92$c$ of the laid-flat position-keeping arm engagement section 92, the handle 9 is no longer kept in the laid-flat position, and continues to be moved in the anticlockwise direction indicated in FIG. 11B. Specifically, the keeping of the handle 9 in the laid-flat position ends when the handle 9 has been rotated from the laid-flat position by about 10 degrees in the anticlockwise direction indicated in FIG. 11B. At this time, the protrusion 91$p$ is pressed against the underlying laid-flat position-keeping arm engagement section 92 by the elastic force of the laid-flat position-keeping arm 91, and therefore, a downward pressing force indicated by an arrow Ar6 is applied to the laid-flat position-keeping arm engagement section 92.

Thus, the laid-flat position-keeping detent mechanism 90 keeps the handle 9 in the laid-flat position, and when at least the predetermined force (La, a force that can dislodge the protrusion 91$p$ from the recessed section 92$c$) is applied to the handle 9, ends the keeping of the handle gin the laid-flat position, which allows the handle 9 to rotate and transition to the upright position.

When the handle 9 is transitioned from the upright position to the laid-flat position, the laid-flat position-keeping detent mechanism 90 operates in an opposite manner to that in the transition from the laid-flat position to the upright position. Specifically, when the handle 9 is rotated in the direction that causes the handle 9 to tilt until the handle 9 is very close to the laid-flat position, the laid-flat position-keeping arm 91 is in contact with the flat section 92$s$ of the laid-flat position-keeping arm engagement section 92. In this situation, when the user applies at least the predetermined force to the handle 9 in the direction that causes the handle 9 to tilt, the handle 9 is further rotated with the laid-flat position-keeping arm 91 bent in the direction that causes the tip thereof to move toward the rotating shaft 62. At this time, the protrusion 91$p$ is also pressed against the underlying laid-flat position-keeping arm engagement section 92 by the elastic force of the laid-flat position-keeping arm 91. Therefore, the downward pressing force indicated by the arrow Ar6 is applied to the laid-flat position-keeping arm engagement section 92. When the handle 9 is completely transitioned to the laid-flat position, the protrusion 91$p$ is moved past the flat section 92$s$ of the laid-flat position-keeping arm engagement section 92 to be inserted into the recessed section 92$c$, so that the laid-flat position-keeping arm 91 returns to an original shape thereof, which allows the handle 9 to be kept in the laid-flat position.

Thus, if, when the handle 9 is very close to the laid-flat position, at least the predetermined force (i.e., a force that can cause the protrusion 91*p* to be inserted into the recessed section 92*c*) is applied to the handle 9 in the direction that causes the handle 9 to tilt, the laid-flat position-keeping detent mechanism 90 allows the handle 9 to rotate and transition to the laid-flat position, and keeps the handle 9 in the laid-flat position.

As illustrated in FIGS. 8A and 8B, the fixation device housing 40 is further provided with a lever 100 that is configured to, when the left handle 9 is in the upright position, protrude through an opening 40*h* provided at a left side surface 40L of the fixation device housing 40. The lever 100 is configured to be moved in association with the rotation of the handle 9, and when the handle 9 is transitioned from the upright position to the laid-flat position, protrude through the opening 40*h*.

Figure 12A:
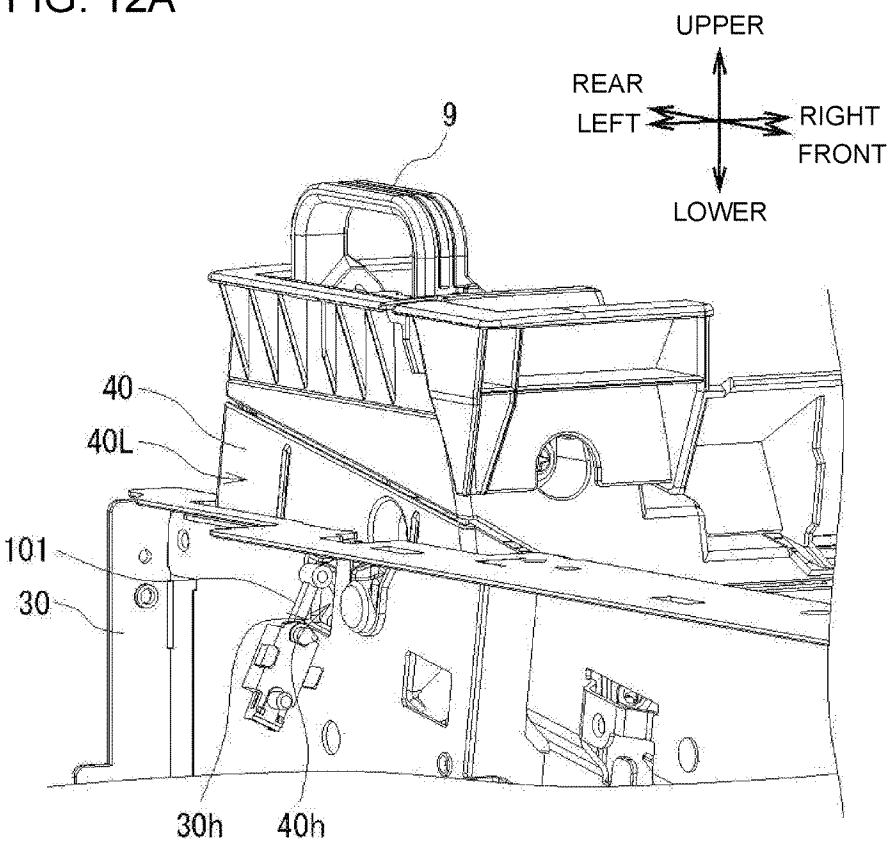
FIGS. 12A and 12B are enlarged perspective views illustrating a left portion of a fixation device housing as it is contained in a fixation device compartment.
Figure 12B:
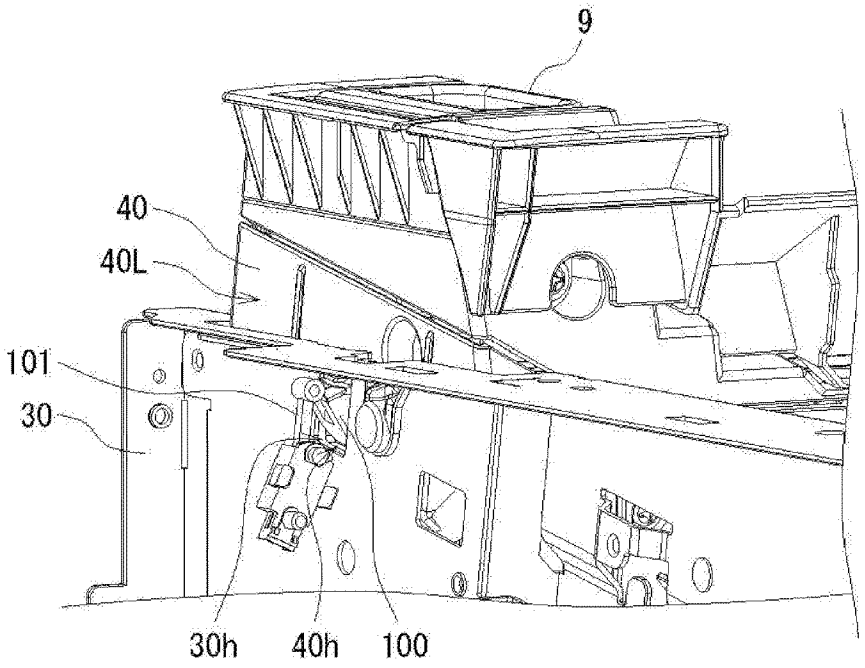

Here, FIGS. 12A and 12B illustrate a left portion of the fixation device housing 40 as it is contained in the fixation device compartment 30. Note that the handle 9 is in the upright position in FIG. 12A, and in the laid-flat position in FIG. 12B.

The fixation device compartment 30 is provided with a lever fitting hole 30*h* at a position that is opposite the opening 40*h* provided at the left side surface 40L of the fixation device housing 40 when the fixation device housing 40 is contained in the fixation device compartment 30. If, when the fixation device housing 40 is contained in the fixation device compartment 30, the handle 9 is transitioned from the upright position to the laid-flat position, the lever 100 protrudes through the opening 40*h* of the fixation device housing 40, and is fitted into the lever fitting hole 30*h*. Although not illustrated, a lever that protrudes through an opening when the right handle 9 is in the upright position is also provided at a right side surface of the fixation device housing 40. That lever is fitted into a lever fitting hole of the fixation device compartment 30.

Thus, if, when the fixation device housing 40 is contained in the fixation device compartment 30, the handle 9 is transitioned from the upright position to the laid-flat position, the lever 100 protrudes from the fixation device housing 40, and is fitted into the lever fitting hole 30*h* of the fixation device compartment 30, whereby the fixation device housing 40 is fixed to the fixation device compartment 30.

In the course of the rotation and transition of the handle 9 from the upright position to the laid-flat position (rotational zone), the lever 100 does not protrudes from the fixation device housing 40 while the handle 9 is kept in the upright position by the upright position-keeping detent mechanism 80 (i.e., until the handle 9 has been rotated by about 10 degrees with respect to the upright position (upright zone)), and protrudes from the fixation device housing 40 after the handle 9 has been rotated past the upright zone. In other words, unless the handle 9 is in the upright position, the fixation device 8 cannot be removed from the image formation apparatus 1.

As illustrated in FIGS. 12A and 12B, the fixation device compartment 30 is provided with a lock switch 101 that, when the lever 100 is fitted into the lever fitting hole 30*h*, is turned on by being pressed by a tip of the lever 100. Although not illustrated, a similar lock switch is provided on the right side of the fixation device compartment 30. The image formation apparatus 1 is configured such that, when the left and right lock switches 101 are on, the control unit 10 recognizes that the fixation device 8 is completely attached. If at least one of the left and right lock switches 101 is turned off during printing, the control unit 10 recognizes that the fixation device 8 has been removed, and stops printing.

Figure 13A:
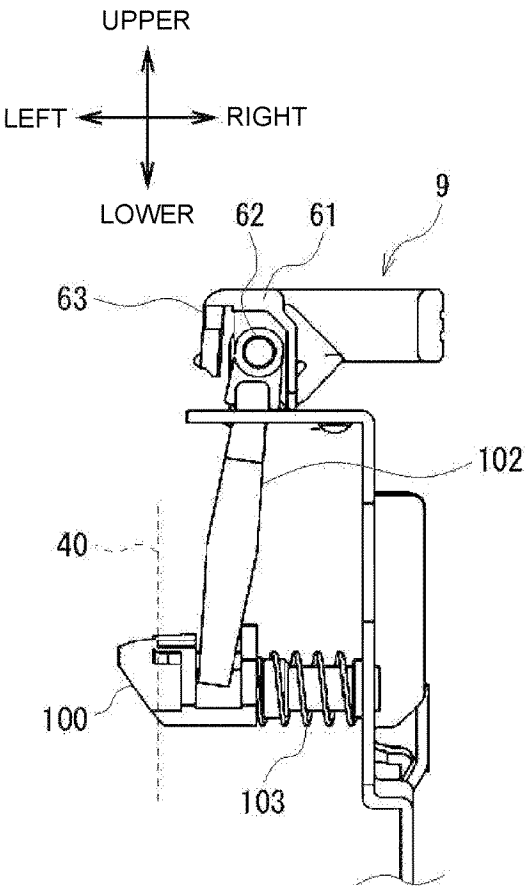
FIGS. 13A to 13C are partial cross-sectional views illustrating a configuration of a linking member.
Figure 13B:
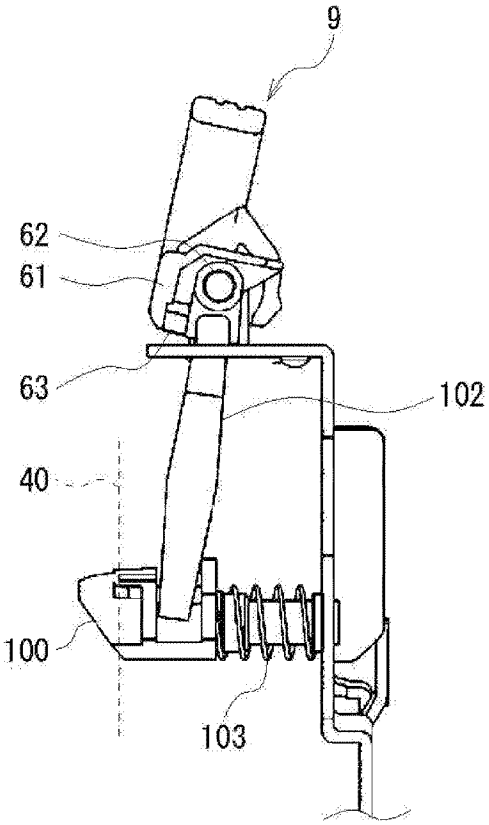
Figure 13C:
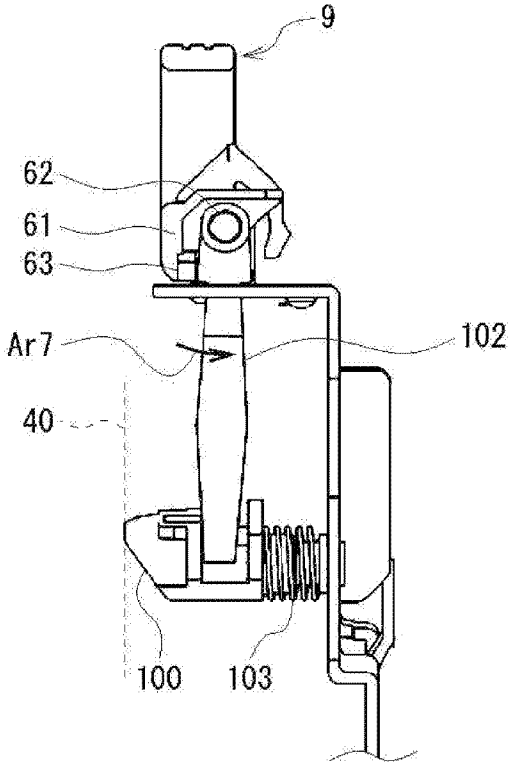

Next, a linking member 102 that allows the handle 9 and the lever 100 to move in associated with each other is briefly described with reference to FIGS. 9A, 9B, and 13A to 13C. FIGS. 13A to 13C are each an elevation view as viewed from the front, including a cross-sectional view of the handle 9.

The linking member 102 is a bar-shaped member that is elongated in the upward/downward direction, and is located between a middle portion in the axial direction (forward/backward direction) of the attachment section 61 of the handle 9, and the lever 100, which is located below the middle portion, extending in the leftward/rightward direction. A lower end of the linking member 102 is linked to the lever 100, and an upper end of the linking member 102 is supported by the attachment section 61 of the handle 9 in a manner that allows the linking member 102 to rotate about the rotating shaft 62. Specifically, the rotation of the linking member 102 about the rotating shaft 62 can move the lever 100 in the direction that causes the lever 100 to protrude from the fixation device housing 40 and in the direction that causes the lever 100 to be put into the fixation device housing 40.

The attachment section 61 of the handle 9 is provided with a lever contact part 63 that is located at a middle in the axial direction (between the two upright position-keeping arms 81) and is configured to be brought into contact with an upper end of the linking member 102. The lever contact part 63 is brought into contact with the upper end of the linking member 102 (a portion below the rotating shaft 62) immediately before the handle 9 is transitioned to the upright position. In this state, while the handle 9 is being rotated until the handle 9 is transitioned to the upright position, the lever contact part 63 presses the linking member 102, which is in turn rotated in the same direction in which the handle 9 is rotated.

The lever 100 is also pressed by a pressing member 103 such as a spring in the direction that causes the lever 100 to protrude from the fixation device housing 40.

Here, movements of the handle 9, the lever 100, and the linking member 102 are briefly described with reference to FIGS. 13A to 13C. As illustrated in FIG. 13A, when the handle 9 is in the laid-flat position, the lever contact part 63 of the handle 9 is separated from the upper end of the linking member 102. In this state, the lever 100 protrudes from the fixation device housing 40 due to a pressing force of the pressing member 103 as indicated by a dashed line in FIG. 13A.

During the transition of the handle 9 from this state to the upright position, the lever contact part 63 of the handle 9 is brought into contact with the upper end of the linking member 102 immediately before the handle 9 is transitioned to the upright position as illustrated in FIG. 13B. At this time, the lever 100 still protrudes from the fixation device housing 40.

In this state, when the handle 9 is further moved toward the upright position, the linking member 102 is rotated about the rotating shaft 62 in an anticlockwise direction indicated by an arrow Ar7 by the lever contact part 63 of the handle 9 pressing the upper end of the linking member 102 rightward (inward in the longitudinal direction of the fixation device housing 40) as illustrated in FIG. 13C. At this time, the lower end of the linking member 102 is moved in a rightward direction that causes the lever 100 to be put into the fixation device housing 40. As a result, the lever 100, which is linked to the lower end of the linking member 102, is moved rightward against the pressing force to be put into the fixation device housing 40.

Thus, the linking member 102 is configured to, when the handle 9 is transitioned to the upright position, cause the lever 100 to be put into the fixation device housing 40. Conversely, when the handle 9 is transitioned from the upright position to the laid-flat position, the linking member 102 causes the lever 100 to protrude from the fixation device housing 40. Configurations of the handle 9 and surrounding parts have been described.

4. Operation of Attaching Fixation Device

Next, an operation of attaching the fixation device 8 to the image formation apparatus 1 is described. As described above, the fixation device 8 is attached to the image formation apparatus 1 by the following procedure: the user grasps the handle 9 as it is in the upright position, lifts up the fixation device 8, and inserts the fixation device 8 into the image formation apparatus 1 through the cover opening 7 of the apparatus cover 2*c*; and the user pushes the fixation device 8 until the fixation device 8 is completely contained in the apparatus housing 2 of the image formation apparatus 1.

As a result, the fixation device 8 is contained in the fixation device compartment 30, which is provided in the apparatus housing 2, and the connector 43 of the fixation device 8 is mated to the connector 31 of the fixation device compartment 30, and the gear part 44 of the fixation device 8 is engaged with the gear part 32 of the fixation device compartment 30.

Incidentally, in order to reliably mate the connector 43 of the fixation device 8 to the connector 31 of the fixation device compartment 30, a force set to a specific value for the connectors 43 and 31 is required. For the image formation apparatus 1 according to an embodiment, the specific value is set to 2 kgf. Thus, it is necessary to exert a force of at least 2 kgf in order to reliably mate the connector 43 to the connector 31.

Meanwhile, for the image formation apparatus 1 according to an embodiment, the weight of the fixation device 8 itself is 1.5 kgf. Therefore, when the fixation device 8 is inserted through the cover opening 7 and is caused to move downward only due to its own weight, the force (1.5 kgf) exerted by the weight of the fixation device 8 itself is smaller than the force (2 kgf) necessary to reliably mate the connector 43 to the connector 31. Therefore, the connector 43 of the fixation device 8 cannot be reliably mated to the connector 31 of the fixation device compartment 30.

In other words, when the fixation device 8 is inserted through the cover opening 7 and then attached to the image formation apparatus 1, then if the force exerted during the insertion is too weak, the connector 43 of the fixation device 8 fails to be reliably mated to the connector 31 of the fixation device compartment 30, and therefore, the fixation device 8 fails to be reliably attached to the image formation apparatus 1.

Under the circumstances described above, for the image formation apparatus 1 according to an embodiment, the fixation device 8 is provided with the laid-flat position-keeping detent mechanism 90 for keeping the handle 9 in the laid-flat position, and the user is required to apply at least the predetermined force set for the laid-flat position-keeping detent mechanism 90 to the handle 9 in order to transition the handle 9 to the laid-flat position. This force is used to reliably mate the connector 43 of the fixation device 8 to the connector 31 of the fixation device compartment 30.

Specifically, the user grasps the handle 9 as it is in the upright position, lifts up the fixation device 8, and inserts the fixation device 8 into the image formation apparatus 1 through the cover opening 7 of the apparatus cover 2*c*. Thereafter, the user moves the fixation device 8 downward until the fixation device 8 is completely contained in the apparatus housing 2.

After the fixation device 8 is completely inserted, the user lays the handle 9 flat, i.e., transitions the handle 9 from the upright position to the laid-flat position. At this time, the user rotates and transitions the handle 9 from the upright position to a position that is very close to the laid-flat position, and then applies at least the predetermined force set for the laid-flat position-keeping detent mechanism 90 to the handle 9 so as to rotate and transition the handle 9 to the laid-flat position.

Figure 14:
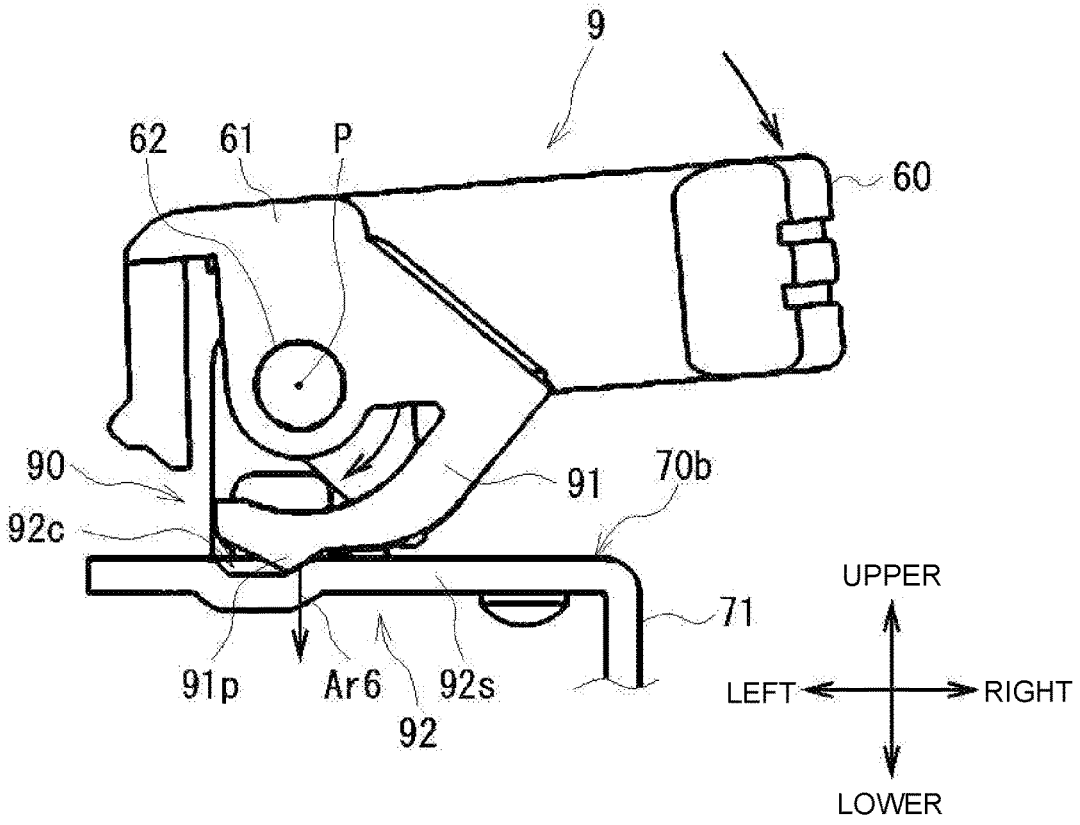
FIG. 14 is a cross-sectional view illustrating a handle as it is immediately before the handle is transitioned to a laid-flat position.

At this time, as illustrated in FIG. 14, the protrusion 91*p* is pressed against the underlying laid-flat position-keeping arm engagement section 92 due to the elastic force of the laid-flat position-keeping arm 91. Therefore, the laid-flat position-keeping arm 91 applies the downward pressing force indicated by the arrow Ar6 to the laid-flat position-keeping arm engagement section 92. The force by which the laid-flat position-keeping arm 91 presses the laid-flat position-keeping arm engagement section 92 downward is used to mate the connector 43 of the fixation device 8 to the underlying connector 31 of the fixation device compartment 30.

Specifically, if Fa+Ff>Fc, the connector 43 can be reliably mated to the underlying connector 31, where Fa represents the force by which the laid-flat position-keeping arm 91 presses the laid-flat position-keeping arm engagement section 92 downward, Fc represents the force (2 kgf) necessary to reliably mate the connector 43 to the underlying connector 31, and Ff represents the weight (1.5 kgf) of the fixation device 8 itself.

In this case, if the force (Fa) by which the laid-flat position-keeping arm 91 presses the laid-flat position-keeping arm engagement section 92 downward is greater than the difference (0.5 kgf) between Fc (2 kgf) minus Ff (1.5 kgf), the connector 43 can be reliably mated to the underlying connector 31.

Therefore, for the laid-flat position-keeping detent mechanism 90, the amount of displacement of the tip of the laid-flat position-keeping arm 91 that occurs when the laid-flat position-keeping arm 91 is bent, the thickness of the laid-flat position-keeping arm 91, or the like, is appropriately selected so as to establish Fa>0.5 kgf.

Actually, when the fixation device 8 is put into the fixation device compartment 30, the fixation device 8 receives a predetermined reaction force from the fixation device compartment 30 due to, for example, contact with the fixation device compartment 30. Therefore, it is desirable to take such a reaction force into consideration in setting the force (Fa) by which the laid-flat position-keeping arm 91 presses the laid-flat position-keeping arm engagement section 92 downward.

Specifically, if Fa+Ff>Fc+Fo, the connector 43 can be reliably mated to the underlying connector 31, where Fo represents the maximum value of a reaction force that the fixation device 8 receives from the fixation device compartment 30.

In this case, if the force (Fa) by which the laid-flat position-keeping arm 91 presses the laid-flat position-keeping arm engagement section 92 downward is greater than the difference (0.74 kgf) between the sum of Fc (2 kgf) and Fo (e.g., 0.24 kgf) minus Ff (1.5 kgf), the connector 43 can be reliably mated to the underlying connector 31.

Therefore, for the laid-flat position-keeping detent mechanism 90 according to an embodiment, the amount of displacement of the tip of the laid-flat position-keeping arm 91 that occurs when the laid-flat position-keeping arm 91 is bent, the thickness of the laid-flat position-keeping arm 91, or the like, is appropriately selected so as to establish Fa>0.74 kgf. Specifically, the displacement amount is set to 0.6 mm±0.2 mm, and the thickness is set to 2.5 mm.

With the configuration described above of the image formation apparatus 1 according to an embodiment, when the fixation device 8 is attached to the image formation apparatus 1, the connector 43 of the fixation device 8 can be reliably mated to the connector 31 of the fixation device compartment 30. Thus, the fixation device 8 can be reliably attached to the image formation apparatus 1. The operation of attaching the fixation device 8 to the image formation apparatus 1 is as described above.

5. Effects

As described above, the image formation apparatus 1 according to an embodiment includes: the apparatus housing 2 having, at an outer peripheral portion thereof, the stacker 5 on which paper M (medium) is stacked, the cover opening 7 being provided at the stacker 5; the image formation units 20 (image formation unit) that are provided in the apparatus housing 2 and form an image on paper M; and the fixation device 8 that is removably attached to the apparatus housing 2, is removably attached to the apparatus housing 2 through the cover opening 7 (opening), and fixes, to the paper M, the image formed on the paper M by the image formation units 20. When the fixation device 8 is attached to the apparatus housing 2, a portion (upper end) of the fixation device 8 is exposed from the cover opening 7 provided at the stacker 5 to form a portion of the stacker 5, and the connector 43 of the fixation device 8 is mated to the connector 31 of the apparatus housing 2.

The fixation device 8 includes, at an exposed portion (upper end) thereof exposed from the cover opening 7, the handle 9 that is allowed to transition between the upright position in which the handle 9 stands with respect to the exposed portion and the laid-flat position in which the handle 9 is laid flat with respect to the exposed portion.

The image formation apparatus 1 includes the laid-flat position-keeping detent mechanism 90 that, when at least the predetermined force is applied to the handle 9 in order to transition the handle 9 to the laid-flat position, allows the handle 9 to transition to the laid-flat position and keeps the handle 9 in the laid-flat position.

More specifically; the laid-flat position-keeping detent mechanism 90 includes the laid-flat position-keeping arm 91 (laid-flat position-keeping elastic member), and the laid-flat position-keeping arm engagement section 92 (laid-flat position-keeping contact member). During the rotation and transition of the handle 9 from the upright position to the laid-flat position, the protrusion 91*p* of the laid-flat position-keeping arm 91 is brought into contact with the flat section 92*s* of the laid-flat position-keeping arm engagement section 92 immediately before the handle 9 is transitioned to the laid-flat position. Here, when at least the predetermined force is applied to the handle 9 in the direction that causes the handle 9 to transition to the laid-flat position, the handle 9 is rotated with the laid-flat position-keeping arm 91 in contact with and bent by the laid-flat position-keeping arm engagement section 92, and when the handle 9 is transitioned to the laid-flat position, the protrusion 91*p* of the laid-flat position-keeping arm 91 is moved past the flat section 92*s* of the laid-flat position-keeping arm engagement section 92 and is put into the recessed section 92*c*, so that the laid-flat position-keeping arm 91 returns to an original shape thereof, which allows the handle 9 to be kept in the laid-flat position. In addition, while the handle 9 is being rotated with the laid-flat position-keeping arm 91 in contact with and bent by the laid-flat position-keeping arm engagement section 92, the fixation device 8 is pressed by the elastic force of the laid-flat position-keeping arm 91 in the direction that causes the connector 43 of the fixation device 8 to be mated to the connector 31 of the apparatus housing 2.

Thus; for example, after the user grasps the handle 9 as it is in the upright position and inserts the fixation device 8 into the image formation apparatus 1 through the cover opening 7, at least the predetermined force set for the laid-flat position-keeping detent mechanism 90 is applied to the handle 9 in order to cause the handle 9 to transition from the upright position to the laid-flat position. This force can be used to reliably mate the connector 43 of the fixation device 8 to the connector 31 of the apparatus housing 2. Thus, in the image formation apparatus 1, the fixation device 8 can be reliably attached to the apparatus housing 2.

The image formation apparatus 1 further includes the upright position-keeping detent mechanism 80 (detent mechanism) that, when at least the predetermined force is applied to the handle 9 in order to cause the handle 9 to transition to the upright position, causes the handle 9 to transition to the upright position, and keeps the handle 9 in the upright position.

More specifically, the upright position-keeping detent mechanism 80 includes the upright position-keeping arm 81 (upright position-keeping elastic member), and the upright position-keeping arm engagement section 82 (upright position-keeping contact member). During the rotation and transition of the handle 9 from the laid-flat position to the upright position, the protrusion 81*p* of the upright position-keeping arm 81 is brought into contact with the upright position-keeping arm engagement section 82 immediately before the handle 9 is transitioned to the upright position. Here, when at least the predetermined force is applied to the handle 9 in the direction that causes the handle 9 to rotate and transition to the upright position, the handle 9 is rotated with the upright position-keeping arm 81 in contact with and bent by the upright position-keeping arm engagement section 82, and when the handle 9 is transitioned to the upright position, the protrusion 81*p* of the upright position-keeping arm 81 is moved past the upright position-keeping arm engagement section 82, so that the upright position-keeping arm 81 returns to an original shape thereof, which allows the handle 9 to be kept in the upright position.

Thus, for example, the handle 9 can be kept in the upright position during an operation of attaching or removing the fixation device 8 to or from the apparatus housing 2. Therefore, the user can easily attach or remove the fixation device 8 while grasping the handle 9.

The image formation apparatus 1 further includes the levers 100 that, when the handle 9 is kept in the upright position by the upright position-keeping detent mechanism 80, are put in the fixation device housing 40 of the fixation device 8, and otherwise, protrude from the left and right side surfaces of the fixation device housing 40 (an accommodation section where the fixation device 8 is accommodated in the apparatus housing 2). The levers 100, when protrude from the fixation device housing 40, are fitted into the fixation device compartment 30 of the apparatus housing 2, whereby the fixation device housing 40 is fixed to the fixation device compartment 30.

The image formation apparatus 1 further includes the lock switch 101 (detector) that detects the protrusion of the lever 100 from the fixation device housing 40 that occurs when the fixation device housing 40 is contained in the fixation device compartment 30. When the lock switch 101 detects the protrusion of the lever 100, the control unit 10 determines that the fixation device 8 is attached to the apparatus housing 2.

Thus, in the image formation apparatus 1, for example, even if, after the fixation device 8 is attached to the apparatus housing 2, a hand or the like of a user who is trying to pick up paper M discharged to the stacker 5 merely hits the handle 9, the handle 9 is not transitioned from the laid-flat position to the upright position. Therefore, it is possible to avoid situations in which the user accidentally causes the handle 9 to transition to the upright position and thereby ends fixation of the fixation device 8, and the control unit 10 determines that the fixation device 8 has been removed from the apparatus housing 2 and ends printing.

In addition, in the image formation apparatus 1, when the handle 9 is kept in the upright position by the upright position-keeping detent mechanism 80, the lever 100 is put in the fixation device housing 40. Therefore, by causing the handle 9 to be in the upright position, the lever 100 can be kept in the state in which the lever 100 does not protrude from the fixation device housing 40. As a result, it is possible to avoid, for example, a situation that during an operation of attaching the fixation device 8 to the apparatus housing 2, the lever 100 protrudes from the fixation device housing 40 and hits and breaks the apparatus housing 2.

6. Other Embodiments

6-1. First Alternative Embodiment

In one or more embodiments described above, the case has been described in which the upright position-keeping arm 81, which includes a plate spring member, and the upright position-keeping arm engagement section 82, which is a flat section that is engaged (contact) with the upright position-keeping arm 81, constitute the upright position-keeping detent mechanism 80. Here, for example, the upright position-keeping arm 81 may be provided at the fixation device housing 40, and the upright position-keeping arm engagement section 82 may be provided at the handle 9. Alternatively, another detent mechanism may be employed instead of the upright position-keeping detent mechanism 80 as long as that mechanism can cause the handle 9 to transition to the upright position when at least the predetermined force is applied to the handle 9 in order to cause the handle 9 to transition to the upright position, and keep the handle 9 in the upright position. For example, a detent mechanism having a latch structure may be employed, or a detent mechanism having a rotation prevention structure including an elastic member such as a spring may be employed.

Likewise, the laid-flat position-keeping detent mechanism 90 may, for example, be configured such that the laid-flat position-keeping arm 91 is provided at the fixation device housing 40, and the laid-flat position-keeping arm engagement section 92 is provided at the handle 9. Alternatively, another detent mechanism may be employed as long as that mechanism can cause the handle 9 to transition to the laid-flat position when at least the predetermined force is applied to the handle 9 in order to cause the handle 9 to transition to the laid-flat position, and keep the handle 9 in the laid-flat position.

6-2. Second Alternative Embodiment

In one or more embodiments described above, the case has been described in which the fixation device 8 is provided with the upright position-keeping detent mechanism 80 that keeps the handle 9 in the upright position, and the laid-flat position-keeping detent mechanism 90 that keeps the handle 9 in the laid-flat position. Alternatively, for example, the upright position-keeping detent mechanism 80 may be removed, and only the laid-flat position-keeping detent mechanism 90 may be provided.

6-3. Third Alternative Embodiment

In one or more embodiments described above, the case has been described in which, when the handle 9 is kept in the upright position by the upright position-keeping detent mechanism 80, the lever 100 is put in the fixation device housing 40 of the fixation device 8, and otherwise, the lever 100 protrudes from the fixation device housing 40. Alternatively, for example, the lever 100 may protrude from the fixation device housing 40 only when the handle 9 is kept in the laid-flat position by the laid-flat position-keeping detent mechanism 90.

6-4. Fourth Alternative Embodiment

In one or more embodiments described above, the case has been described in which the lock switches 101 for detecting the protrusion of the levers 100 from the left and right side surfaces of the fixation device housing 40 are provided on both of the left and right sides of the fixation device compartment 30. Alternatively, the lock switch 101 may be provided on only one of the left and right sides of the fixation device compartment 30.

6-5. Fifth Alternative Embodiment

In one or more embodiments described above, the case has been described in which the fixation device 8 is provided with the sub-cover 41. Alternatively, the sub-cover 41 may be removed.

6-6. Sixth Alternative Embodiment

In one or more embodiments described above, the disclosure is applied to the image formation apparatus 1 that is an electrophotographic color printer. Alternatively, the disclosure can be applied to image formation apparatuses having configurations different from that of the image formation apparatus 1 as long as those image formation apparatuses include a fixation device. For example, the disclosure may be applied to an image formation apparatus that is configured such that a toner image formed by an image formation unit is transferred to an intermediate transfer belt before being transferred to a medium. The disclosure may also be applied to a monochromatic image formation apparatus having a single image formation unit, or a color image formation apparatus having four or more image formation units. The disclosure may also be applied to an image formation apparatus that forms an image on a medium other than paper. The disclosure may also be applied to image formation apparatuses such as an electrophotographic photocopier, fax machine, and multifunction peripheral.

6-7. Seventh Alternative Embodiment

Furthermore, the disclosure is not limited to one or more embodiments described above. Specifically, the disclosure encompasses embodiments obtained by combining all or a portion of one or more embodiments described above, or embodiments obtained by extracting a portion of one or more embodiments described above.

The disclosure is widely applicable to, for example, image formation apparatuses such as an electrophotographic printer, photocopier, fax machine, and multifunction peripheral that include a fixation device.

The invention includes other embodiments or modifications in addition to one or more embodiments described above without departing from the spirit of the invention. One or more embodiments described above are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image formation apparatus comprising:

an apparatus housing that includes, at an outer peripheral portion thereof, a stacker, an opening being provided at the stacker;

an image formation unit that is provided in the apparatus housing and configured to form an image on a medium; and a fixation device that is removably attached to the apparatus housing through the opening, and is configured to fix the image formed on the medium by the image formation unit to the medium, wherein the medium having the fixed image thereon is to be discharged onto the stacker, wherein in a state where the fixation device is attached to the apparatus housing, a portion of the fixation device that is exposed from the opening provided at the stacker forms a portion of the stacker, and a connector of the fixation device is mated to a connector of the apparatus housing, the fixation device includes, at the exposed portion thereof exposed from the opening, a handle that is allowed to transition between an upright position in which the handle stands with respect to the exposed portion and a laid-flat position in which the handle is laid flat with respect to the exposed portion, and the image formation apparatus further includes a laid-flat position-keeping detent mechanism that, when at least a predetermined force is applied to the handle in order to transition the handle from the upright position to the laid-flat position, allows the handle to transition to the laid-flat position and keeps the handle in the laid-flat position.

2. The image formation apparatus according to claim 1, wherein by at least the predetermined force being applied to the handle in order to transition the handle from the upright position to the laid-flat position after the fixation device is inserted through the opening, the fixation device is pressed in a direction that causes the connector of the fixation device to be mated to the connector of the apparatus housing.

3. The image formation apparatus according to claim 2, wherein the handle is supported by the fixation device in a manner that allows the handle to rotate between the upright position and the laid-flat position, and the laid-flat position-keeping detent mechanism includes a laid-flat position-keeping elastic member and a laid-flat position-keeping contact member that are arranged in a manner that upon rotation of the handle from the upright position to the laid-flat position, the laid-flat position-keeping elastic member is brought into contact with the laid-flat position-keeping contact member immediately before the handle is transitioned to the laid-flat position, in a contact state where the laid-flat position-keeping elastic member is in contact with the laid-flat position-keeping contact member, by at least the predetermined force being applied to the handle in a direction that causes the handle to rotate to the laid-flat position, the handle is rotated with the laid-flat position-keeping elastic member being deformed by the laid-flat position-keeping contact member, and when the handle reaches to the laid-flat position, the laid-flat position-keeping elastic member is moved past the laid-flat position-keeping contact member and returns to an original shape of the laid-flat position-keeping elastic member, which causes the handle to be kept in the laid-flat position.

4. The image formation apparatus according to claim 3, wherein while the handle is being rotated with the laid-flat position-keeping elastic member being deformed by the laid-flat position-keeping contact member, the fixation device is pressed by an elastic force of the laid-flat position-keeping elastic member in a direction that causes the connector of the fixation device to be mated to the connector of the apparatus housing.

5. The image formation apparatus according to claim 1, further comprising:

an upright position-keeping detent mechanism that, by at least a second predetermined force being applied to the handle in order to transition the handle from the laid-flat position to the upright position, allows the handle to transition to the upright position and keeps the handle in the upright position.

6. The image formation apparatus according to claim 5, wherein the handle is supported by the fixation device in a manner that allows the handle to rotate between the upright position and the laid-flat position, and the upright position-keeping detent mechanism includes an upright position-keeping elastic member and an upright position-keeping contact member that are arranged in a manner that upon rotation of the handle from the laid-flat position to the upright position, the upright position-keeping elastic member is brought into contact with the upright position-keeping contact member immediately before the handle is transitioned to the upright position, in a contact state where the upright position-keeping elastic member is in contact with the upright position-keeping contact member, by at least the second predetermined force being applied to the handle in a direction that causes the handle to rotate to the upright position, the handle is rotated with the upright position-keeping elastic member being deformed by the upright position-keeping contact member, and when the handle reaches the upright position, the upright position-keeping elastic member is moved past the upright position-keeping contact member and returns to an original shape of the upright position-keeping elastic member, which allows the handle to be kept in the upright position.

7. The image formation apparatus according to claim 1, wherein the fixation device includes a lever that protrudes from an accommodation section where the fixation device is accommodated in the apparatus housing in a state where the handle is in the laid-flat position, and when the handle is transitioned from the upright position to the laid-flat position in the state where the fixation device is attached to the apparatus housing, the lever protrudes from the accommodation section and is fitted into the apparatus housing.

8. The image formation apparatus according to claim 7, wherein the lever does not protrude from the accommodation section in a state where the handle is in the upright position, and the lever protrudes from the accommodation section in the state where the handle is in the laid-flat position and in a state where the handle is in between the upright position and the laid-flat position.

9. The image formation apparatus according to claim 7, further comprising:

a detector that is provided at the apparatus housing and configured to detect protrusion of the lever from the accommodation section of the fixation device.

* * * * *